US011904203B2

(12) United States Patent
Holman

(10) Patent No.: US 11,904,203 B2
(45) Date of Patent: Feb. 20, 2024

(54) EXERCISE APPARATUS AND METHODS OF OPERATION THEREOF

(71) Applicant: Aspen Integrative Kinetics, LLC, Aspen, CO (US)

(72) Inventor: Peter A. Holman, Aspen, CO (US)

(73) Assignee: Aspen Integrative Kinetics, LLC, Aspen, CO (US)

( * ) Notice: Subject to any disclaimer, the term of this patent is extended or adjusted under 35 U.S.C. 154(b) by 275 days.

(21) Appl. No.: 17/381,894

(22) Filed: Jul. 21, 2021

(65) Prior Publication Data

US 2022/0023714 A1 Jan. 27, 2022

Related U.S. Application Data

(60) Provisional application No. 63/199,805, filed on Jan. 26, 2021, provisional application No. 62/705,889, filed on Jul. 21, 2020.

(51) Int. Cl.

| | |
|---|---|
| ***A63B 22/20*** | (2006.01) |
| ***A63B 21/04*** | (2006.01) |
| ***A63B 21/00*** | (2006.01) |

(52) U.S. Cl.

CPC ..... *A63B 22/203* (2013.01); *A63B 21/00065* (2013.01); *A63B 21/0428* (2013.01); *A63B 21/4034* (2015.10)

(58) Field of Classification Search

CPC ..... A63B 22/203; A63B 21/00065; A63B 21/0428; A63B 21/4034; A63B 21/0628; A63B 2071/025; A63B 2022/003; A63B 21/4045; A63B 21/0407; A63B 21/0442; A63B 21/00058; A63B 22/0087; A63B 2022/0079; A63B 22/201; A63B 2210/50; A63B 22/0076–0089; A63B 22/20–208; A63B 21/02; A63B 21/023–026; A63B 21/05–0557

See application file for complete search history.

(56) References Cited

U.S. PATENT DOCUMENTS 1,980,036 A * 11/1934 Casler ..... A63B 22/0076 482/72
3,559,986 A 2/1971 Ehrmantraut
(Continued)

FOREIGN PATENT DOCUMENTS

KR 10-1965387 * 4/2019 ..... A63B 21/0552
KR 102092669 B1 3/2020
WO 2019203845 A1 10/2019

OTHER PUBLICATIONS

Translation of KR 10-1965387 (Year: 2019).*
(Continued)

*Primary Examiner* — Joshua Lee
*Assistant Examiner* — Catrina A Letterman
(74) *Attorney, Agent, or Firm* — Armstrong Teasdale LLP

(57) ABSTRACT

An exercise apparatus includes a stationary foot platform, a slidable foot platform including a foot block having an inclined surface for engagement with a user's active foot, at least one resistance member selectively couplable to the slidable foot platform to selectively adjust a resistance to movement of the slidable foot platform, and a lip extending upwardly from the stationary foot platform to brace a user's stationary foot.

6 Claims, 30 Drawing Sheets

(56) References Cited

U.S. PATENT DOCUMENTS

| | | | | | |
|---|---|---|---|---|---|
| 4,706,953 | A * | 11/1987 | Graham | A63B 21/4009 | 482/133 |
| 4,826,158 | A * | 5/1989 | Fields, Jr. | A63B 23/0488 | 482/142 |
| 5,364,327 | A * | 11/1994 | Graham | A63B 21/0552 | 482/133 |
| 5,393,282 | A | 2/1995 | Maclean | | |
| 5,509,870 | A | 4/1996 | Lloyd | | |
| 5,607,381 | A | 3/1997 | Endelman | | |
| 5,681,249 | A | 10/1997 | Endelman | | |
| 6,042,523 | A * | 3/2000 | Graham | A63B 22/203 | 482/79 |
| 6,045,491 | A * | 4/2000 | McNergney | A63B 22/0087 | 482/121 |
| 6,120,425 | A * | 9/2000 | Endelman | A63B 23/03525 | 482/142 |
| 6,186,929 | B1 | 2/2001 | Endelman et al. | | |
| 6,371,895 | B1 * | 4/2002 | Endelman | A63B 22/0087 | 482/96 |
| 6,926,650 | B2 * | 8/2005 | Endelman | A63B 21/05 | 482/121 |
| 6,942,487 | B2 | 9/2005 | Corbalis | | |
| 6,971,976 | B2 | 12/2005 | Endelman et al. | | |
| 6,991,588 | B1 | 1/2006 | Adams | | |
| 7,014,595 | B2 | 3/2006 | Bruno | | |
| 7,104,901 | B1 | 9/2006 | Mason | | |
| 7,163,500 | B2 | 1/2007 | Endelman et al. | | |
| 7,172,538 | B2 | 2/2007 | Keiser | | |
| 7,223,216 | B1 | 5/2007 | McBride | | |
| 7,364,531 | B2 | 4/2008 | Chu | | |
| 7,674,211 | B2 | 3/2010 | Uygan | | |
| D623,244 | S | 9/2010 | Hoffman | | |
| 7,931,570 | B2 * | 4/2011 | Hoffman | A63B 23/03533 | 482/129 |
| D659,206 | S | 5/2012 | Oberwelz et al. | | |
| 8,192,338 | B2 * | 6/2012 | Solow | A63B 22/0087 | 482/142 |
| 8,394,005 | B2 | 3/2013 | Solow et al. | | |
| 8,529,412 | B2 | 9/2013 | Reade | | |
| 8,641,585 | B2 | 2/2014 | LaGree | | |
| 8,663,074 | B2 | 3/2014 | Uygan | | |
| 8,876,670 | B2 | 11/2014 | Reade | | |
| 9,011,296 | B2 | 4/2015 | Peralo | | |
| 9,199,123 | B2 | 12/2015 | Solow et al. | | |
| 9,868,011 | B2 | 1/2018 | Lagree | | |
| 9,919,181 | B1 | 3/2018 | Lee | | |
| 10,076,695 | B1 | 9/2018 | Simon | | |
| 10,272,281 | B2 | 4/2019 | Aronson et al. | | |
| 10,478,702 | B2 | 11/2019 | Markowitz | | |
| 10,518,125 | B2 * | 12/2019 | Janowski | A63B 22/0076 | |
| 10,569,118 | B2 * | 2/2020 | Lagree | A63B 21/4045 | |
| 2007/0135280 | A1 * | 6/2007 | Hamer | A63B 23/0355 | 482/148 |
| 2010/0216612 | A1 * | 8/2010 | Graham | A63B 23/0417 | 482/121 |
| 2012/0283079 | A1 | 11/2012 | Solow et al. | | |
| 2013/0056942 | A1 | 3/2013 | Maratta | | |
| 2014/0100089 | A1 | 4/2014 | Kermath et al. | | |
| 2014/0121076 | A1 * | 5/2014 | Lagree | A63B 22/0089 | 482/123 |
| 2014/0141948 | A1 * | 5/2014 | Aronson | A63B 22/0087 | 482/128 |
| 2014/0213423 | A1 * | 7/2014 | Masterson | A63B 21/156 | 482/131 |
| 2015/0065320 | A1 * | 3/2015 | Anderson | A63B 21/156 | 482/142 |
| 2015/0197311 | A1 | 7/2015 | Entrekin | | |
| 2015/0246263 | A1 | 9/2015 | Campanaro et al. | | |
| 2015/0251037 | A1 | 9/2015 | Runyan | | |
| 2015/0367170 | A1 | 12/2015 | Robertson | | |
| 2018/0021620 | A1 * | 1/2018 | Merrithew | A63B 23/0355 | 482/121 |
| 2018/0099177 | A1 | 4/2018 | Anderson et al. | | |
| 2018/0117388 | A1 | 5/2018 | Porter et al. | | |
| 2018/0361190 | A1 * | 12/2018 | Lagree | A63B 21/023 | |
| 2019/0184227 | A1 | 6/2019 | Gouzenko | | |
| 2019/0282878 | A1 | 9/2019 | Gouzenko | | |
| 2019/0290955 | A1 | 9/2019 | Duffy | | |
| 2019/0308058 | A1 | 10/2019 | Endelman et al. | | |
| 2020/0078656 | A1 | 3/2020 | Markowitz | | |
| 2020/0094103 | A1 | 3/2020 | Wallander | | |
| 2020/0121969 | A1 | 4/2020 | Spelman | | |
| 2020/0171337 | A1 * | 6/2020 | Lagree | A63B 21/4035 | |
| 2022/0387845 | A1 * | 12/2022 | Bentivoglio | A63B 21/00065 | |

OTHER PUBLICATIONS

Scott Pilates Document (derived from: IDEA, "Side Splits" [online], Apr. 1, 2009 [retrieved on Jun. 15, 2023], IDEA Health & Fitness Association, Retrieved from: https://www.ideafit.com/uncategorized/side-splits/) (Year: 2009).*

React Physical Therapy Document (derived from: React Physical Therapy, "Reverse Lunges on Pilates Reformer" [online], Oct. 3, 2017 [retrieved on Jun. 15, 2023], Youtube, Retrieved from: https://www.youtube.com/watch?v=f21D2Yn3KWQ) (Year: 2017).*

"Slide Board Pro", product webpage, Hockeyshot Inc., 12 pages, retrieved on Nov. 4, 2021, accessed online at URL: https://www.hockeyshot.com/products/slide-board-pro?a=1&gclid=CjwKCAjwvZv0BRA8EiwAD9T2VU2t7Ma1_mysS71kgA9S7deu9w4L5pXTPPT8TfeOnromouXYV6JRxoCZROQAvD_BWE.

"Rialto™ Reformer", product webpage, Balanced Body, retrieved on Nov. 4, 2021, accessed online at URL: https://www.pilates.com/store/pilates-equipment/reformers/rialto/.

"Pilates Reformer", product webpage, Sharper Image, retrieved on Nov. 4, 2021; accessed online at URL: https://www.sharperimage.com/si/view/product/Pilates+Reformer/206286?p=plist2470005&utm_source=Google&utm_medium=CPC&utm_campaign=Shopping+PLAs+-+Medium&Keyword=&device=c&creative=379894056892&cm_mmc=CPC-_-Google-_-Shopping+PLAs+-+Medium-_-379894056892&network=g&matchtype=&adpos=&creative=379894056892&mkwid=Y4vq6n6E|pkw|pcrid.

Continuation of URL from citation 3: 379894056892|pmt|pdv|c|slid|productid|206286-01|&gclid=CjwKCAjwvZv0BRA8EiwAD9T2VZBu043nZuWgkFEO87mGQTXCXYbeHayN9CNH0duTFsLb612um-Q_2RoC6RUQAvD_BwE.

"Glute Ham Roller", product webpage, Sorinex Exercise Equipment, Inc., 3 pages, retrieved on Nov. 4, 2021, accessed online at URL: https://www.sorinex.com/products/glute-ham-roller?gclid=CjwKCAjwvZv0BRA8EiwAD9T2VQ15JyzIAWGV8rrBh0Tew-OVL4CDFdAdgYCP43aSL5IW_IRSG9OcTxoC1xgQAvD_BwE.

"Rialto™ Reformer by Balanced Body®", YouTube video, 2 pages, dated Nov. 27, 2018, accessed online at URL: https://www.youtube.com/watch?v=_3MY5XNbBuk.

"Abductor Slide", YouTube video, 2 pages, dated Oct. 27, 2016, accessed online at URL: https://www.youtube.com/watch?v=hIN5ZwFxtV4.

"Standing Leg Slides in Pilates Reformer Lane Cove at Soulful Fitness", Youtube video, 2 pages, dated Oct. 18, 2015, accessed online at URL: https://www.youtube.com/watch?v=U0a6JQZs49c.

"MiniPress", product webpage, Shuttle Systems, 4 pages, retrieved on Nov. 19, 2021, accessed online at URL: https://www.shuttlesystems.com/collections/shuttle-minipress/products/used-shuttle-minipress.

"Shuttle Mini-Press", Owner's Manual, Contemporary Design Company, Shuttle Systems, 39 pages, retrieved on Nov. 19, 2021, accessed online at URL: https://www.rehabmart.com/pdfs/shuttle_minipress_owners_manual_v2.pdf.

"Shuttle Mini-Press", product webpage, Hopkins Medical Products, 3 pages, retrieved on Nov. 19, 2021, accessed online at URL: https://www.hopkinsmedicalproducts.com/product/Shuttle-Mini-Press-HMP?option=HM98954-BL.

* cited by examiner

EXERCISE APPARATUS AND METHODS OF OPERATION THEREOF

CROSS-REFERENCE TO RELATED APPLICATIONS

This application claims priority to U.S. Provisional Patent Application No. 63/199,805, filed Jan. 26, 2021, and to U.S. Provisional Patent Application No. 62/705,889, filed Jul. 21, 2020, each of which is hereby incorporated by reference herein.

BACKGROUND

This disclosure is directed to an exercise apparatus, and, more specifically, to an exercise apparatus for exercising gluteal muscles.

Various known commercial machines can be used for exercising gluteal muscles (e.g., posterior and/or lateral gluteal muscles), such as kick-back machines that use either free weights or selectorized weight plates for selective resistance. Notably, such commercial machines may be limited in use to a single type of exercise, such as a kick-back motion, such that only a single muscle or muscle group is activated. Moreover, these machines can be large (e.g., have a large footprint), difficult to move, cost-prohibitive, or otherwise impractical for individual users and, in some cases, even for commercial gym proprietors.

Also known are elastic resistance bands, which can be used for a variety of exercises, some of which target gluteal muscles. However, resistance bands can be displaced during use thereof and can "snap back" on the user, limiting their usability and leading to potential injury. Moreover, many users may find it difficult to properly execute exercises using these bands, as there is an unlimited range of motion that can lead to improper form.

Accordingly, a need exists for an apparatus that enables exercising multiple gluteal muscles, is useable and accessible outside of a commercial gym (e.g., is smaller than some known commercial machines and may be relatively inexpensive), encourages proper form for improved muscle activation, and reduces risk to a user.

BRIEF DESCRIPTION OF THE DISCLOSURE

In one aspect, an exercise apparatus is provided. The exercise apparatus includes a stationary foot platform, a slidable foot platform including a foot block having an inclined surface for engagement with a user's active foot, at least one resistance member selectively couplable to the slidable foot platform to selectively adjust a resistance to movement of the slidable foot platform, and a lip extending upwardly from the stationary foot platform to brace a user's stationary foot.

In another aspect, an exercise apparatus is provided. The exercise apparatus includes a stationary foot platform and a slidable foot platform including a foot block having an inclined surface for engagement with a user's active foot. The slidable foot platform is moveable between a first position in which the slidable foot platform is adjacent to the stationary foot platform and a second, extended position in which the slidable foot platform is spaced from the stationary foot platform. The exercise apparatus also includes a plurality of resistance members selectively couplable to the slidable foot platform to selectively adjust a resistance on the slidable foot platform, and a coupling assembly including a plurality of rods coupled to the slidable foot platform.

Each rod of the plurality of rods is selectively couplable to a corresponding resistance member of the plurality of resistance members to couple the corresponding resistance member to slidable foot platform. The resistance on the slidable foot platform imparted by one or more of the plurality of resistance members coupled to the slidable foot platform by a corresponding one or more of the plurality of rods increases as the slidable foot platform is moved from the first position to the second, extended position.

In a further aspect, a method of operating an exercise apparatus is provided. The method includes positioning, by a user, a stationary foot on a stationary foot platform, the stationary foot platform having a lip extending upwardly therefrom, and engaging the stationary foot with the lip. The method also includes positioning, by the user, an active foot on a slidable foot platform, the slidable foot platform including a foot block having an inclined surface, and engaging the active foot with the inclined surface. The method further includes selectively coupling one or more of a plurality of resistance members to the slidable foot platform, and translating the slidable foot platform between a first position in which the slidable foot platform is adjacent to the stationary foot platform and a second, extended position in which the slidable foot platform is spaced from the stationary foot platform.

DETAILED DESCRIPTION OF THE DISCLOSURE

The exercise apparatus provided herein is distinct from known exercise machines and overcomes the disadvantages of these machines or of simple resistance bands. In particular, the exercise apparatus orients the user in a more functional position that is more representational of real-life movements that involve the gluteal muscles while improving stabilization and guided motion that enhances targeted muscle activation. Moreover, the exercise apparatus described herein can be sized and manufactured to be more affordable, accessible, and portable, compared to other known machines.

The exercise apparatus includes a stationary foot platform and a slidable foot platform, both coupled to a base. One or more resistance members are selectively couplable to the slidable foot platform, according to the user's exercise needs. The user positions one foot (e.g., a stationary foot) on the stationary foot platform and the other foot (e.g., an active foot) on the slidable foot platform. The user braces or stabilizes using the stationary foot on the stationary foot platform, and pushes against the slidable foot platform to slide the slidable foot platform away from the stationary foot platform, thereby pushing against the resistance provided by the one or more resistance members as the slidable foot platform is extended. The user can exercise their lateral gluteal muscles by positioning their feet "side-by-side" on the two platforms, or can exercise their posterior gluteal muscles by positioning one foot in front of the other on the two platforms. The repeated movement of the slide foot laterally or posteriorly places fatigue on the gluteal muscle groups, forcing adaptations such as improved strength, power, and tone as well as enhancements in cardio-respiratory fitness. These fitness benefits are achieved using an exercise apparatus that is specific to gluteal exercise and in a form that is accessible and usable in both residential and commercial (e.g., gym) settings.

Additionally, exercise apparatus of the present disclosure can be used to exercise other muscle groups. For example, it is recognized that incorporating additional elements, such as exercise band anchors and handles, enable the use of the exercise apparatus for additional types of exercises, such as upper-body exercises, core exercises, or exercises simultaneously targeting multiple muscle groups. These additional benefits are realized while maintaining the above-described benefits over conventional exercise machines.

Figure 1:
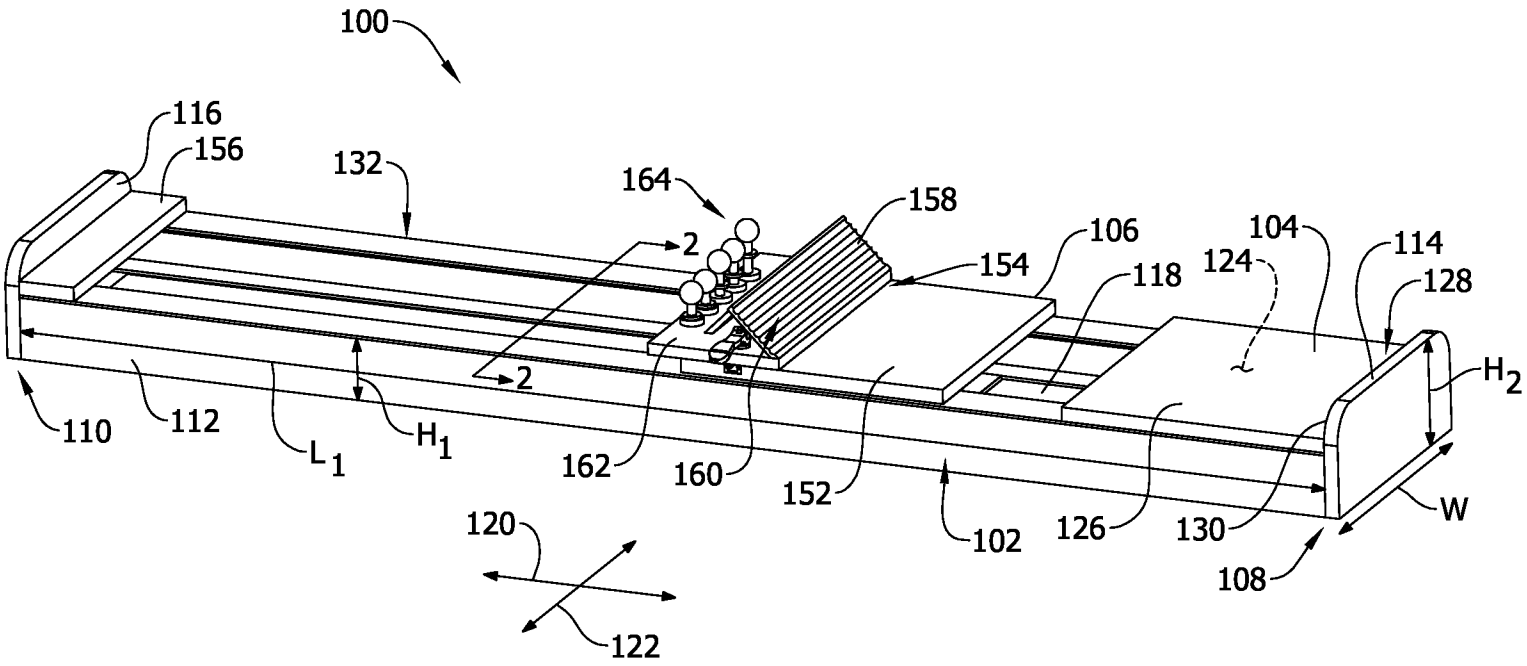
FIG. 1 is a perspective view of an exemplary exercise apparatus.

Turning to FIG. 1, an exemplary exercise apparatus 100 is shown in a perspective view. Broadly, the exercise apparatus 100 includes a base 102, a stationary or fixed foot platform 104 fixedly coupled to the base 102, and a moveable or slidable foot platform 106 that is slidable with respect to the base 102 and the stationary foot platform 104. As described in greater detail herein, a user of the exercise apparatus 100 places one foot (e.g., a stationary or non-active foot) on the stationary foot platform 104 and the other foot (e.g., an active foot) on the slidable foot platform 106, braces or "pushes off" from the stationary foot platform 104 with the stationary foot, and moves the slidable foot platform 106 along the base 102 with the active foot, either laterally or posteriorly (depending on the user's orientation relative to the exercise apparatus 100) to exercise their gluteal muscles.

In the illustrated embodiment, the base 102 extends from a first end 108 to a second end 110 (also referred to as a first end 108 and second end 110, respectively, of the exercise apparatus 100) and includes a pair of side walls 112, a pair of end walls 114, 116, and a bottom wall 118. The side walls 112 extend parallel to one another in a longitudinal direction 120, from the first end 108 to the second end 110 of the base 102, and perpendicular to the end walls 114, 116, which extend parallel to one another in a transverse or lateral direction 122. The side walls 112 each have a first height $H_1$ measured from a bottom to a top of each side wall 112. In the exemplary embodiment, the side walls 112 are rectangular, such that the first height $H_1$ is constant along an entire length $L_1$ of the side walls 112, and the side walls 112 are generally sized and shaped the same as one another. The end walls 114, 116 each have a second height $H_2$ measured from a bottom to a top of each end wall 114, 116. The end walls 114, 116 are substantially rectangular, such that the second height $H_2$ is generally constant along an entire width W of the end walls 114, 116 (although the end walls 114, 116 may have curved or sloped corners, as shown in FIG. 1), and the end walls 114, 116 are generally sized and shaped the same as one another. In the exemplary embodiment, the second height $H_2$ is greater than the first height $H_1$, such that the end walls 114, 116 are taller than the side walls 112.

It is contemplated that the side walls 112 and/or the end walls 114, 116 can vary in alternative embodiments. For example, in an alternative embodiment, the side walls 112 are angled upward (e.g., with an increasing height) from the first end 108 to the second end 110 (e.g., to increase a resistance or difficulty level of using the exercise apparatus 100) or are angled downward (e.g., with a decreasing height) from the first end 108 to the second end 110 (e.g., to decrease the resistance or difficulty level of using the exercise apparatus 100). In another alternative embodiment, the first end wall 114 and/or the second end wall 116 are the same height as the side walls 112.

The bottom wall 118 of the base 102 is coupled between the side walls 112 at the first end 108 of the base 102. The bottom wall 118 is also coupled to the first end wall 114 (e.g., to an interior surface thereof, not shown) and extends towards the second end wall 116. In some embodiments, the bottom wall 118 extends the full length $L_1$ of the side walls 112 and, in such embodiments, is also coupled to the second end wall 116 (e.g., to an interior surface thereof, not shown). In other embodiment, the bottom wall 118 does not extend the full length $L_1$ of the side walls 112, and terminates at an intermediate point between the first and second end walls 114, 116.

The base 102 and components thereof may be formed from any suitable material and in any suitable manner that enables the exercise apparatus 100 to function as described herein. Suitable materials from which the base 102 may be formed include, for example and without limitation, metal, steel, aluminum, wood, plastic, and combinations thereof. In some embodiments, components of the base 102 are formed separately and fastened together with suitable fasteners (e.g., screws, bolts, nuts, etc.). Additionally or alternatively, components of the base 102 may permanently joined to one another, for example, by welding or by being formed monolithically (e.g., casting, molding, etc.).

The stationary foot platform 104 is coupled to the base 102 at the first end 108 thereof. Specifically, the stationary foot platform 104 is coupled to a first end wall 114 of the pair of end walls 114, 116 and to both side walls 112. The stationary foot platform 104, side walls 112, bottom wall 118, and first end wall 114 collectively define a chamber 124 at the first end 108 of the exercise apparatus 100. The stationary foot platform 104 is planar, and a top surface 126 thereof defines a support surface 128 for a user's foot (e.g., a "stationary" foot). In the exemplary embodiment, the first end wall 114 extends above the top surface 126 of the stationary foot platform 104, and defines an upwardly extending lip 130 at the first end 108 of the exercise apparatus 100. The lip 130 further defines the support surface 128 and is configured to brace the user's stationary foot during use of the exercise apparatus 100. Although the lip 130 is defined by the first end wall 114 in the illustrated embodiment, it is contemplated that, in alternative embodiments (e.g., where the end walls 114, 116 are the same height $H_1$ as the side walls 112), the lip 130 may be a separate component coupled to and/or extending upwardly from the top surface 126 of the stationary foot platform 104.

Figure 2:
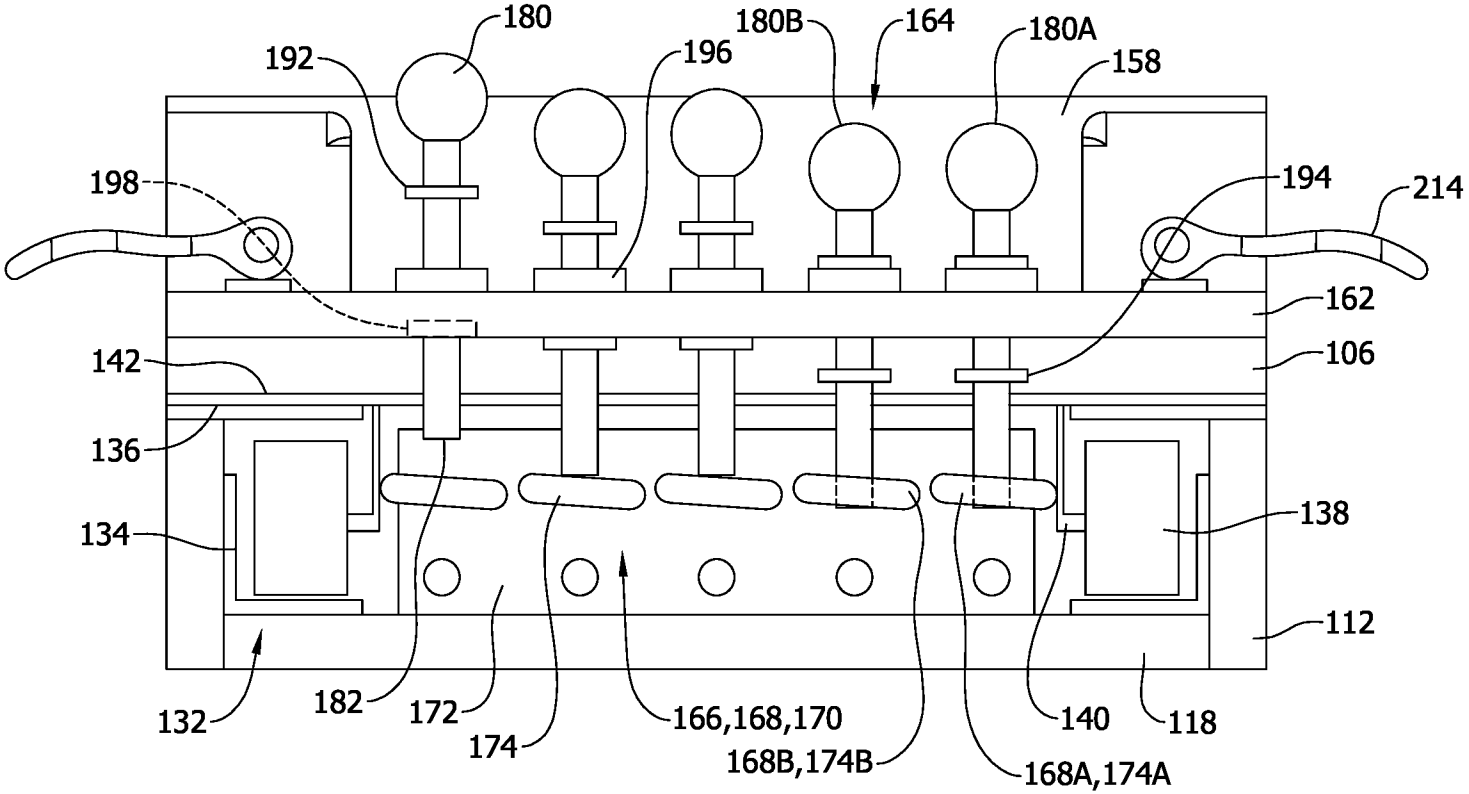
FIG. 2 is a sectional view of the exercise apparatus shown in FIG. 1 taken along line 2-2 in FIG. 1.

The base 102 further includes a pair of linear tracks 132 that extend parallel to one another in the longitudinal direction 120, which also defines a direction of movement of the slidable foot platform 106. Specifically, the slidable foot platform 106 is mounted to the tracks 132 and is movable relative thereto between a first or initial position and a second, extended position. In some embodiments, as shown in FIG. 2, the tracks 132 are embodied as a pair of C-shaped tracks 134 coupled to the side walls 112 and having respective planar upper surfaces 136. A plurality of wheels 138 are coupled to the slidable foot platform 106 (e.g., via a plurality of brackets 140), and each of the wheels 138 is positioned within one of the C-shaped tracks 134. The illustrated embodiment includes four wheels 138 (two shown in FIG. 2), two of which are positioned in-line with one another in the track 134 shown on the left side of the exercise apparatus 100 as shown in FIG. 2, and the other two of which are positioned in-line with one another in the track 134 shown on the right sight of the exercise apparatus 100 as shown in FIG. 2. Rotation of the wheels 138 allow the slidable foot platform 106 to move along the tracks 134. A bottom surface 142 of the slidable foot platform 106 is spaced from the upper surfaces 136 of the tracks 134, to prevent or reduce frictional interaction therebetween.

Figure 4:
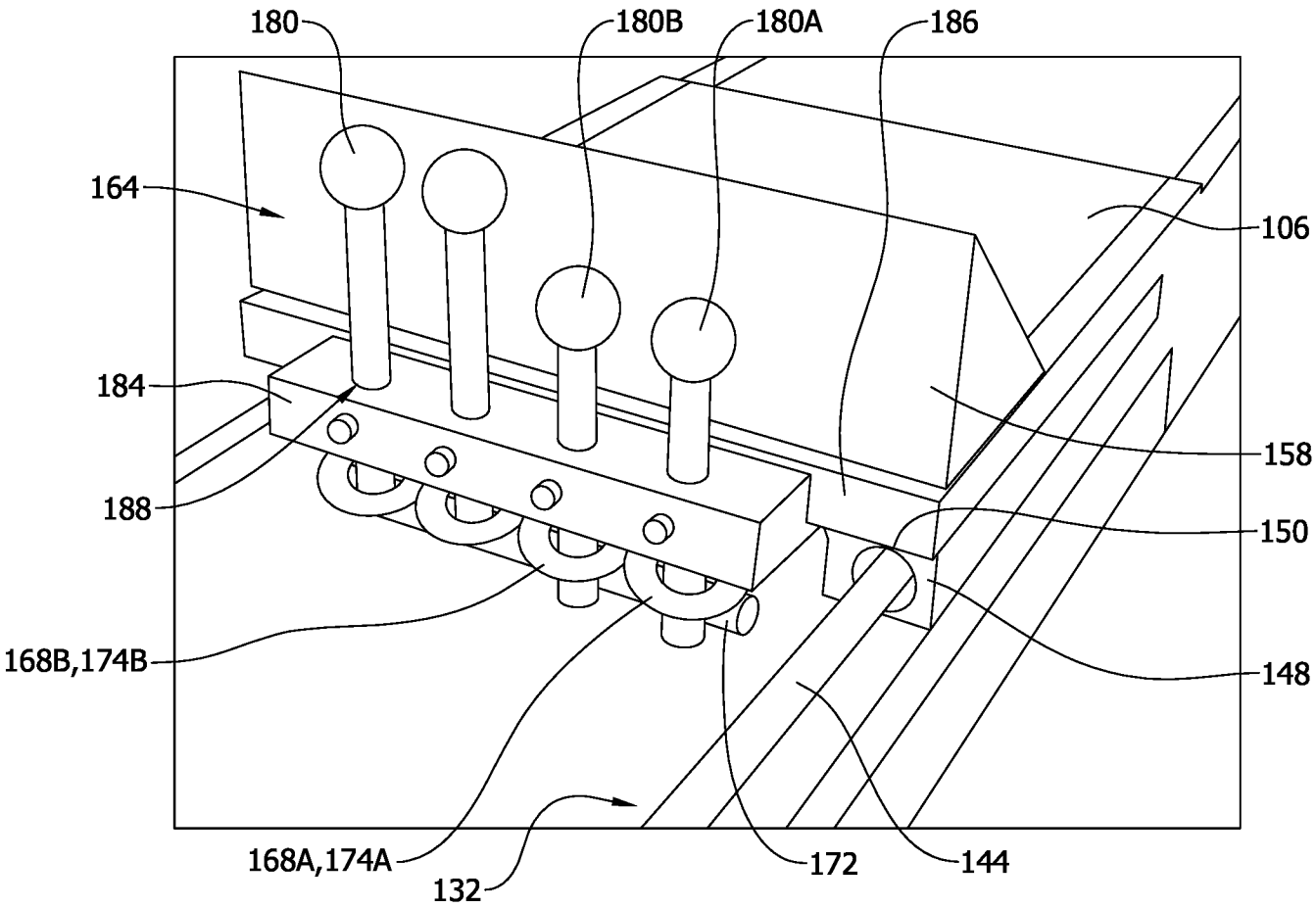
FIG. 4 is a perspective view of another embodiment of a slidable foot platform suitable for use with the exercise apparatus shown in FIG. 1.
Figure 5:
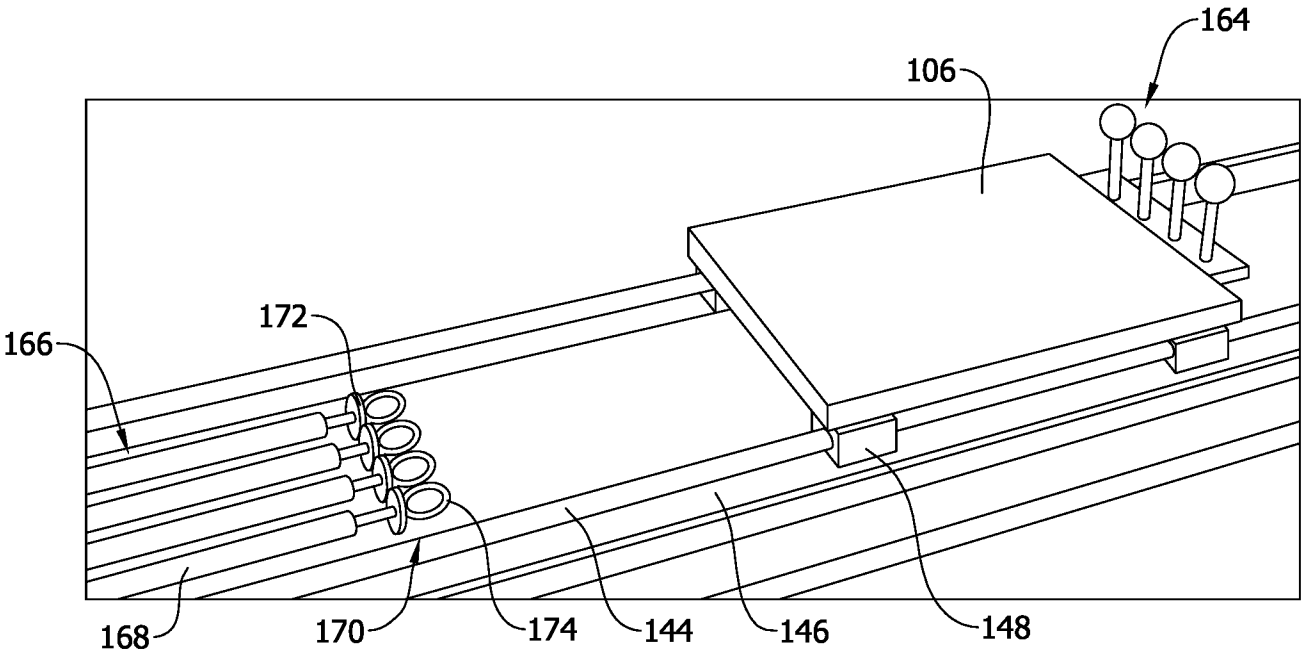
FIG. 5 is a perspective view depicting first ends of resistance members of the exercise apparatus shown in FIG. 1.

In other embodiments, as shown in FIGS. 4 and 5, the tracks 132 are embodied as generally cylindrical rods 144 extending longitudinally on each side of the exercise apparatus 100. The rods 144 are coupled to the side walls 112 by upwardly-extending plates 146 in the embodiment illustrated in FIGS. 4 and 5. The rods 144 may additionally or alternatively be coupled to ends walls 114, 116. In the embodiments illustrated in FIGS. 4 and 5, the slidable foot platform 106 is coupled to the tracks 132 by a plurality of braces 148 coupled to the bottom surface 142 of the slidable foot platform 106. Each brace 148 defines a C-shaped channel 150 sized and shaped complementary to one of the rods 144, and includes bearings or bushings (not shown) therein to reduce friction between the brace 148 and the rod 144. The rods 144 are received in the C-shaped channels 150, and the braces 148 including the channels 150 are translated along the rods 144 as the slidable foot platform 106 is moved. The illustrated embodiment includes four braces 148—two braces 148 are coupled on the right sight of the slidable foot platform 106 in the orientation shown in FIG. 4 and are spaced longitudinally apart from one another, and two braces 148 are coupled on the left side of the slidable foot platform 106 in the orientation shown in FIG. 4 and are spaced longitudinally apart from one another. In other embodiments, the exercise apparatus 100 may include more or less than four braces 148. In one embodiment, for example, the exercise apparatus 100 may include only two braces 148, one coupled to each side of the slidable foot platform 106.

The exercise apparatus 100 may include any other suitable track or slide mechanism that enables the slidable foot platform 106 to slide or translate relative to the stationary foot platform 104. The connection between the slidable foot platform 106 and the tracks 134 suitably has a relatively low level of friction, to reduce wear, sounds generated during operation, and any effect from frictional forces during the user's operation of the exercise apparatus 100.

The slidable foot platform 106 is planar, and a top surface 152 thereof defines a support surface 154 for a user's foot. The slidable foot platform 106 is selectively moveable, relative to the base 102 and the stationary foot platform 104, along the tracks 132 between a first or initial position in which the slidable foot platform 106 is adjacent to the stationary foot platform 104, and a second, extended position in which the slidable foot platform 106 is translated along the tracks 132 away from the stationary foot platform 104. The slidable foot platform 106 may be moved any distance from the stationary foot platform 104 until the tracks 132 terminate at the second end 110 of the base 102 or the second end wall 116, at which position the slidable foot platform 106 is at its fully extended second position and is unable to translate further. In some embodiments, a mechanical stop 156 is provided before the second end wall 116, to prevent repeated contact between the slidable foot platform 106 and the second end wall 116. The mechanical stop 156 may be coupled to the tracks 132, the side wall(s) 112, the second end wall 116, and/or the bottom wall 118 of the exercise apparatus 100. The mechanical stop 156 may include one or more dampers or shock absorbers to reduce the impact of the slidable foot platform 106 against the stop 156. It should be readily understood that there may be a substantially infinite number of second, extended positions of the slidable foot platform 106 between the first position and the fully extended second position.

A foot block 158 is coupled to the top surface 152 of the slidable foot platform 106 and extends the support surface 154 thereof. Specifically, the foot block 158 has an inclined (support) surface 160 for engagement with the user's foot (e.g., an "active" foot). The inclined surface 160 is oriented at an oblique angle relative to the top surface 152 of the slidable foot platform 106. In the illustrated embodiment, the inclined surface 160 is oriented at an angle of approximately 135° relative to the top surface 152 of the slidable foot platform 106. In other embodiments, the inclined surface 160 may be oriented at an angle in the range of 105° to 165° relative to the top surface 152 of the slidable foot platform 106. In some embodiments, the foot block 158 is directly coupled to the top surface 152 of the slidable foot platform 106 (see, for example, FIG. 4). In other embodiments, the foot block 158 is coupled to a sub-platform 162 that is selectively couplable to the slidable foot platform 106 (see, for example, FIG. 3). The foot block 158 is coupled to the slidable foot platform 106 or the sub-platform 162 using any suitable method/component, such as via adhesive, mechanical fasteners, welding, molding, and the like. In some alternative embodiments, the slidable foot platform 106 does not include the foot black (see, for example, FIG. 5). In these embodiments, the user's active foot may engage with a portion or surface of a coupling assembly 164 of the exercise apparatus 100 (described in more detail herein).

Figure 6:
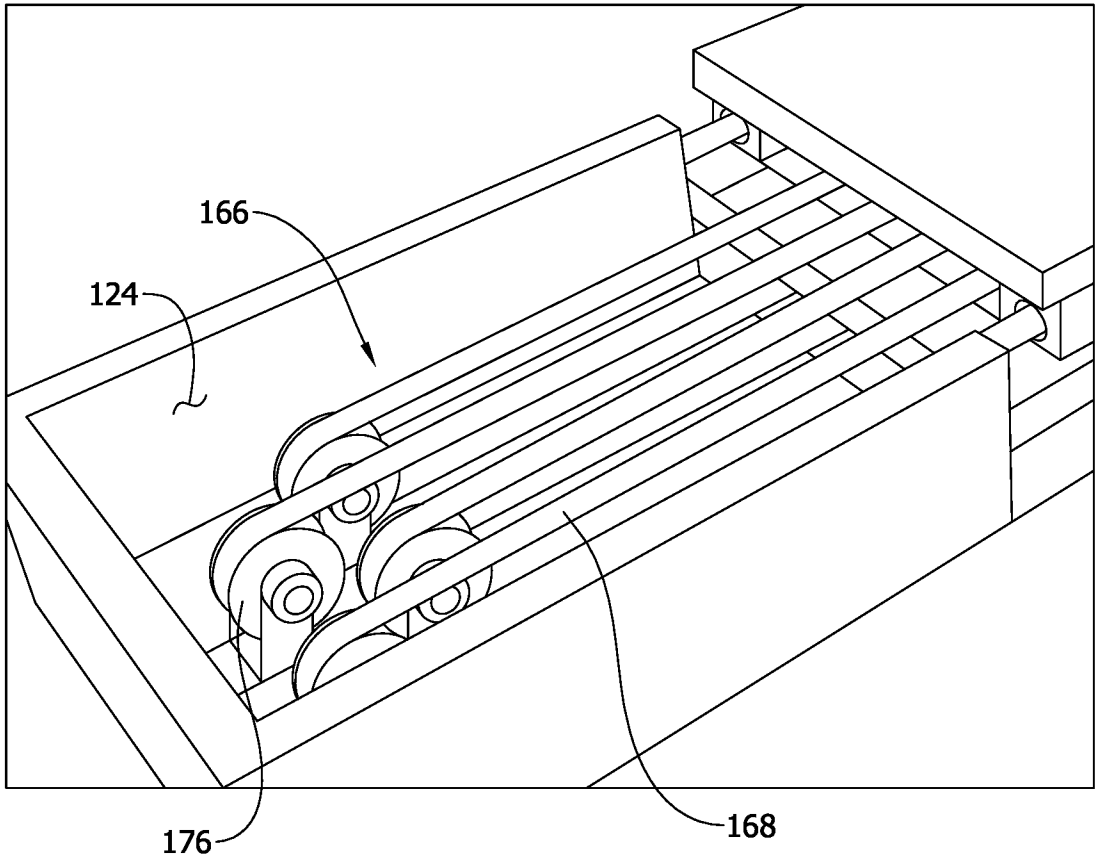
FIG. 6 is a perspective view of a base chamber of the exercise apparatus shown in FIG. 1.
Figure 7:
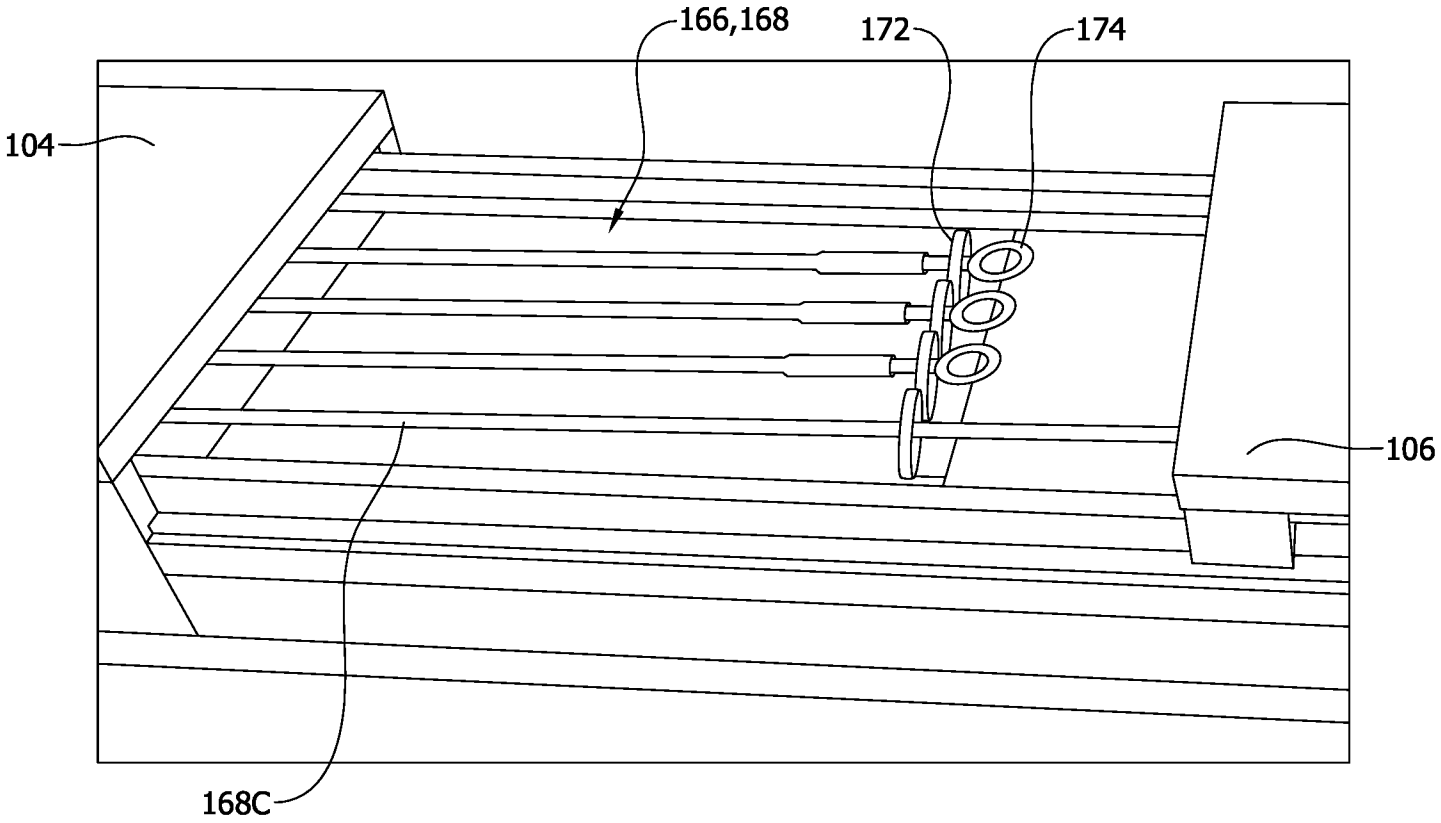
FIG. 7 depicts activation of one resistance member of the exercise apparatus shown in FIG. 1.
Figure 8:
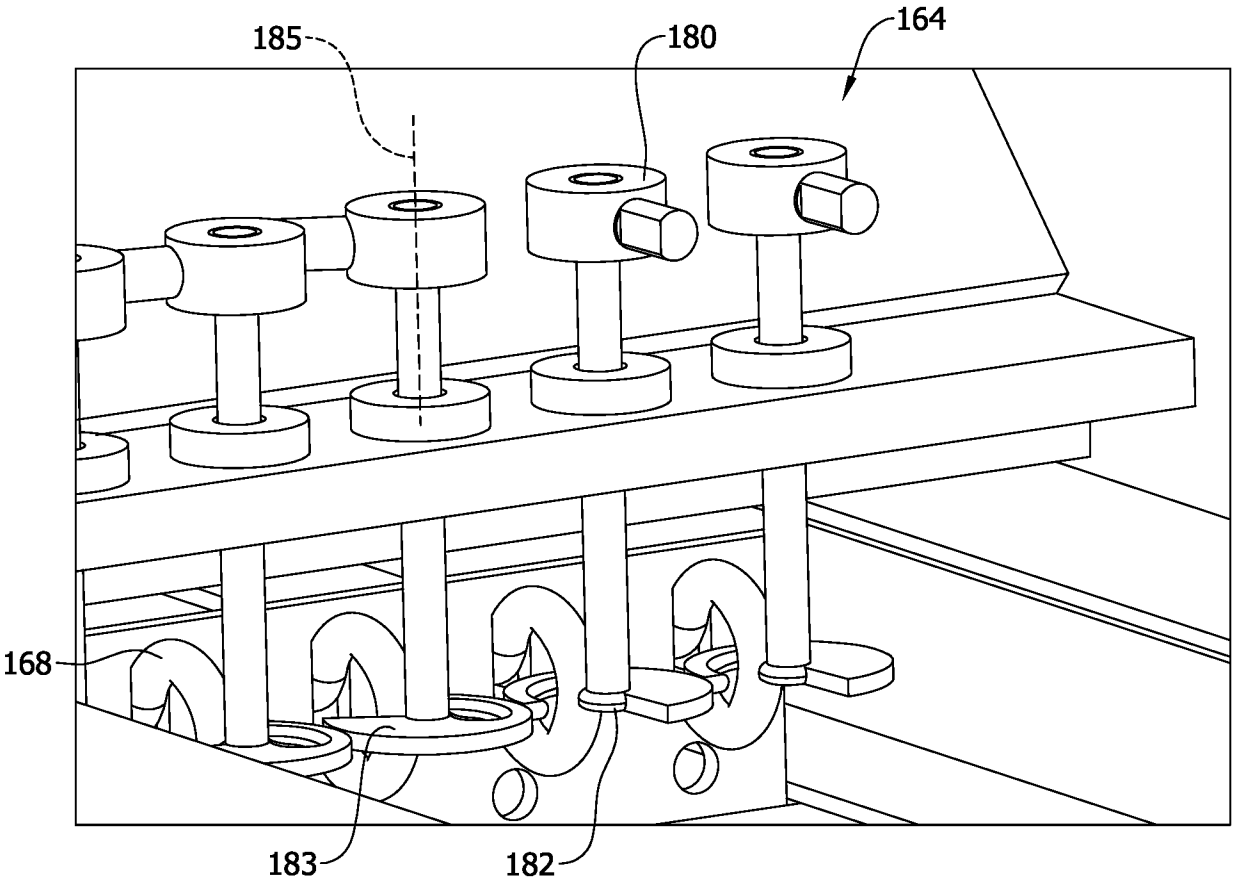
FIG. 8 is a perspective view of an alternative coupling assembly suitable for use with the exercise apparatus shown in FIG. 1.

The exercise apparatus 100 further includes at least one resistance member 166 selectively couplable to the slidable foot platform 106 to selectively adjust a resistance or force imparted on the slidable foot platform 106 during operation of the exercise apparatus 100. "Resistance member" refers to a component or mechanism that provides resistance or a resistive force against movement of the slidable foot platform 106 from its initial position to the extended position. Suitable resistance members include, for example and without limitation, resistance bands, free weights, a weight stack, springs, pneumatics, magnets, brake mechanisms, piston/shock assemblies, and combinations thereof. As shown in FIGS. 5-7, in the exemplary embodiment, the resistance member 166 includes a plurality of resistance members 166, each selectively couplable to the slidable foot platform 106 independently of one another. In particular, the resistance members 166 of the exemplary embodiment are embodied as elastic resistance bands 168. Although the resistance bands 168 are shown as cylindrical or tubular resistance bands, any other suitable resistance band or other resistance member may be used without departing from the scope of the present disclosure. For example, flat or planar resistance bands may be used, or resistance may be adjusted using pneumatic resistance, magnetic resistance, or a braking mechanism, or any combination thereof may be used. In some embodiments, compression-based resistance members, such as compressible pistons or shocks may be used; in these embodiments, the resistance members may be located at the second end 110 of the exercise apparatus 100, rather than at the first end 108 as described with respect to the exemplary embodiments herein. In yet other embodiments, as shown in FIG. 8, the resistance member 166 may include free weights, a weight stack, or any other suitable resistance member that enables the exercise apparatus 100 to function as described herein.

In the exemplary embodiment, first ends 170 of the resistance bands 168 are retained at an initial position by one or more brackets 172 coupled to the base bottom wall 118. The first end 170 of each resistance band 168 includes a ring or loop 174 (also referred to herein as an "end link") coupled thereto. In the exemplary embodiment, these loops 174 are rigid, and each loop 174 is capable of withstanding a tensile force at least as great as the maximum resistive force of the resistance band 168 to which it is coupled without deformation of the loop 174. The bracket 172 limits movement of the first ends 170 of the resistance bands 168. More specifically, the bracket 172 engages the loops 174 to ensure that the loops 174 are in a predefined position prior to operation of the exercise apparatus 100 and/or when each resistance band 168 is not coupled to the slidable foot platform 106, as described further herein.

Each resistance band 168 extends around a respective pulley 176 within the base chamber 124. More specifically, as shown in FIG. 6, a plurality of pulleys 176 (that is, the same number of pulleys 176 as there are resistance bands 168) are coupled to the bottom wall 118 of the base 102, within the chamber 124. Second ends (not shown) of the resistance bands 168 are anchored to the base 102 (e.g., to the base bottom wall 118), and the resistance bands 168 are wrapped about respective pulleys 176. In at least some instances, the second ends of the resistance bands 168 are removably coupled to the base 102, such that each band 168 can be individually removed and replaced. The pulleys 176 facilitate smooth and even extension of the resistance bands 168 during operation of the exercise apparatus 100. Moreover, the location of each pulley 176 can be selected and/or adjusted to define the unextended or "default" length of the corresponding resistance band 168, to adjust resistance imparted by the respective resistance band 168. Therefore, two elastic bands 168 that are otherwise the same can provide different levels of resistance, depending on the position of the respective pulley 176. In alternative embodiment, the resistance bands 168 may not be wrapped around a pulley, and may instead be anchored directly to the base 102 (e.g., at the first end wall 114) and extended in a single linear direction during operation of the exercise apparatus 100.

The resistance bands 168 are selectively couplable to the slidable foot platform 106 to selectively adjust (i.e., increase or decrease) the resistance applied to the slidable foot platform 106 during operation of the exercise apparatus 100. This selective coupling is enabled using a coupling assembly 164, which is coupled to or otherwise associated with the slidable foot platform 106. In the exemplary embodiment, the coupling assembly 164 includes a plurality of rods or "push-pins" 180. The rods 180 may be embodied as pins, as depicted in FIGS. 1-4, or may have other structure(s) integrated therewith, such as hooks, flanges, extensions, and the like. In the illustrated embodiment, the exercise apparatus 100 includes the same number of rods 180 as there are resistance bands 168.

Figure 3:
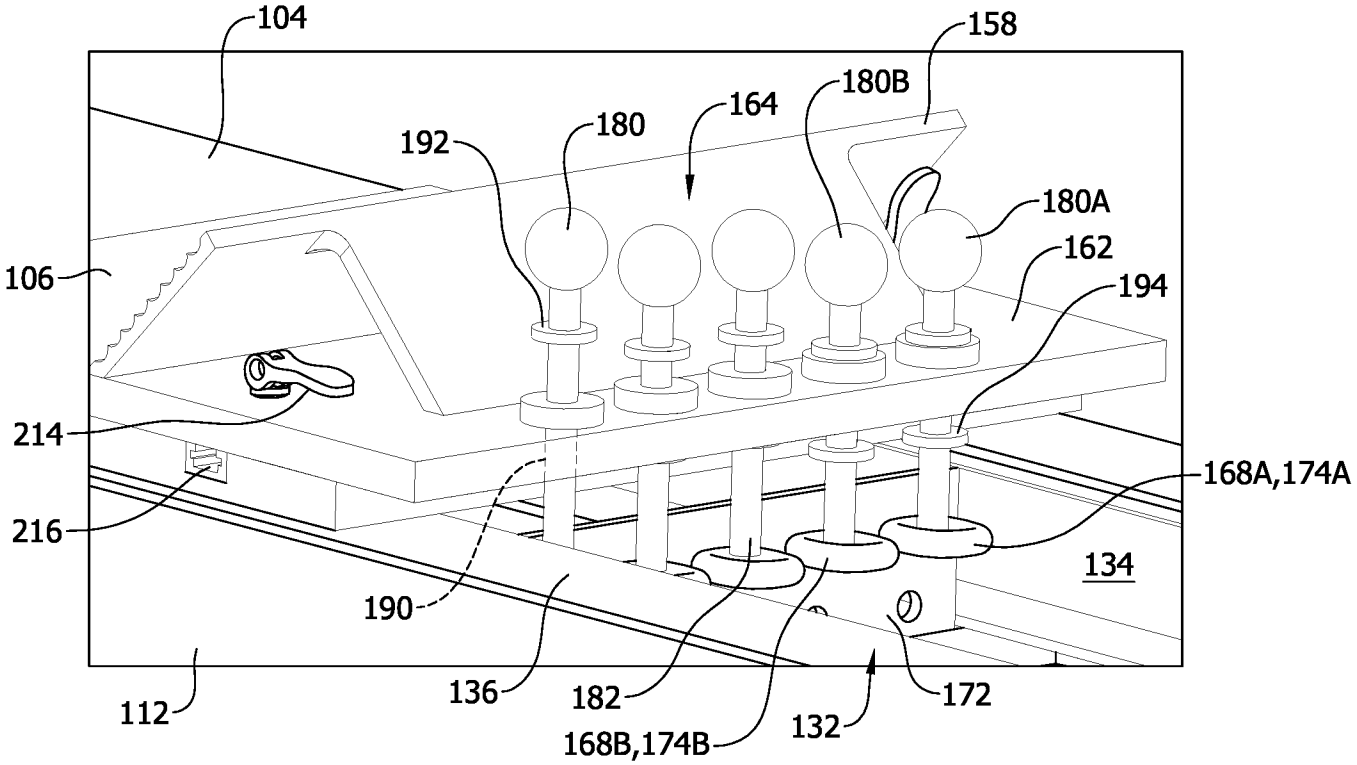
FIG. 3 is a perspective view of a slidable foot platform of the exercise apparatus shown in FIG. 1.

Each rod 180 may be selectively actuated from a first position to a second position to engage a loop 174 of corresponding resistance band 168, and may be subsequently actuated from the second position to the first position to disengage the corresponding loop 174. In the illustrated embodiment of FIGS. 2-4, the first position corresponds to a vertically raised position of the rod 180, and the second position corresponds to a lowered or depressed position of the rod 180. Each rod 180 is actuated from the first position to the second position by applying a downward force (e.g., pushing) and depressing the rod 180, and the rod 180 is actuated from the second position to the first position by applying an upward force (e.g., pulling) and raising the rod 180 from the second position to the first position. More specifically, when the slidable foot platform 106 is in the first or initial position, the rods 180 are aligned with the loops 174 of the resistance bands 168 (see, e.g., FIGS. 2-4). The user of the exercise apparatus 100 may depress or lower one or more of the rods 180. When lowered, a free end 182 of the rod 180 is inserted into the loop 174 of the corresponding resistance band 168. In the embodiments of FIGS. 2-4, the two right-hand rods 180A, 180B are lowered and inserted through the loops 174A, 174B of the corresponding two right-hand resistance bands 168A, 168B. Thereafter, when the user moves the slidable foot platform 106 using their active foot, those corresponding resistance bands 168A, 168B, which are engaged by the lowered rods 180A, 180B, are "activated." That is, those resistance bands 168A, 168B are extended/stretched as the slidable foot platform 106 moves away from the first position to the second, extended position, which increases the resistance on the slidable foot platform 106. FIG. 7 illustrates how an activated resistance band 168C is stretched during operation of the exercise apparatus 100. Specifically, FIG. 7 depicts the slidable foot platform 106 in the second, extended position with a single activated resistance band 168C. When the slidable foot platform 106 is returned to the first position, any lowered rod(s) 180 may be raised to disengage those rod(s) 180 from the corresponding resistance band(s) 168.

In other embodiments, the first position of the rods 180 may correspond to a lowered or depressed position, and the second position of the rods 180 may correspond to a vertically raised position. In such embodiments, the rods 180 may be actuated in an upward direction (i.e., raised) from the first position to the second position to engage the loops 174 of the resistance bands 168. In such embodiments, each rod 180 may include a hook located at a distal end thereof that extends into and engages a loop 174 of a corresponding resistance band 168 when the rod 180 is in the second position.

In still other embodiments, as shown in FIG. 8, the first and second positions of the rods 180 may correspond to different angular positions of the rods 180. Specifically, in this embodiment, each rod 180 includes a hook 183 coupled to and/or extending from the free end 182 thereof. In the first position (see the left-most rods 180 shown in FIG. 8), the hook 183 is disengaged from the loop 174 of the corresponding resistance band 168. In the second position (see the right-most rods 180 shown in FIG. 8), the hook 183 is engaged with (e.g., extends through) the loop 174 of the corresponding resistance band 168. Each rod 180 may be actuated between the first and second positions by rotating the rod 180 about a respective longitudinal axis 185 thereof. In some such embodiments, the rod 180 remains at the same vertical position whether the rod 180 is in the first (disengaged) or second (engaged) position. In other embodiments, the rod 180 may additionally be raised or lowered to transition between the first and second positions, as described above.

In some embodiments, the coupling assembly 164 further includes a bracket 184 coupled to an end surface 186 (and/or the top surface 152 and/or bottom surface 142) of the slidable foot platform 106 (see FIG. 4). The bracket 184 may be coupled to the slidable foot platform 106 using any suitable method/component, including adhesive, mechanical fasteners, welding, molding, and the like. The rods 180 extend through respective channels 188 defined in the bracket 184. In other embodiments, the rods 180 extend through channels 190 defined in the sub-platform 162 coupled to the slidable foot platform 106 (see FIGS. 2 and 3).

In some embodiments, as shown in FIGS. 2 and 3 each rod 180 includes a pair of flanges, including an upper flange 192 and a lower flange 194. These flanges 192, 194 limit the range of vertical movement of the corresponding rod 180. More particularly, the upper flange 192 limits how far the rod 180 can be lowered, such that the free end 182 of the rod 180 does not contact the bottom wall 118 of the base 102. The lower flange 194 limits how far the rod 180 can be raised, preventing the rod 180 from being inadvertently removed from the coupling assembly 164. The coupling assembly 164 may include one or more vertical extensions 196 and/or indents 198 with which the flanges 192, 194 may engage. In particular, in some embodiments, extensions 196 are magnetic, and magnetically couple to flange 192 to retain the rod 180 in the lowered position. Additionally or alternatively, indents 198 include magnets (not shown) therein, which magnetically couple to flange 194 to keep the corresponding rod(s) 180 in the raised position. Additionally, in some embodiments, one or more of the rods 180 may include a retainer (e.g., ball detents) to retain the rod in the raised or lowered position. The retainer may also provide tactile and/or audible feedback (e.g., an audible and/or tactilely-perceptible "click") to a user when the associated rod 180 is actuated to indicate that the rod has been fully actuated to the raised and/or lowered position.

Figure 9:
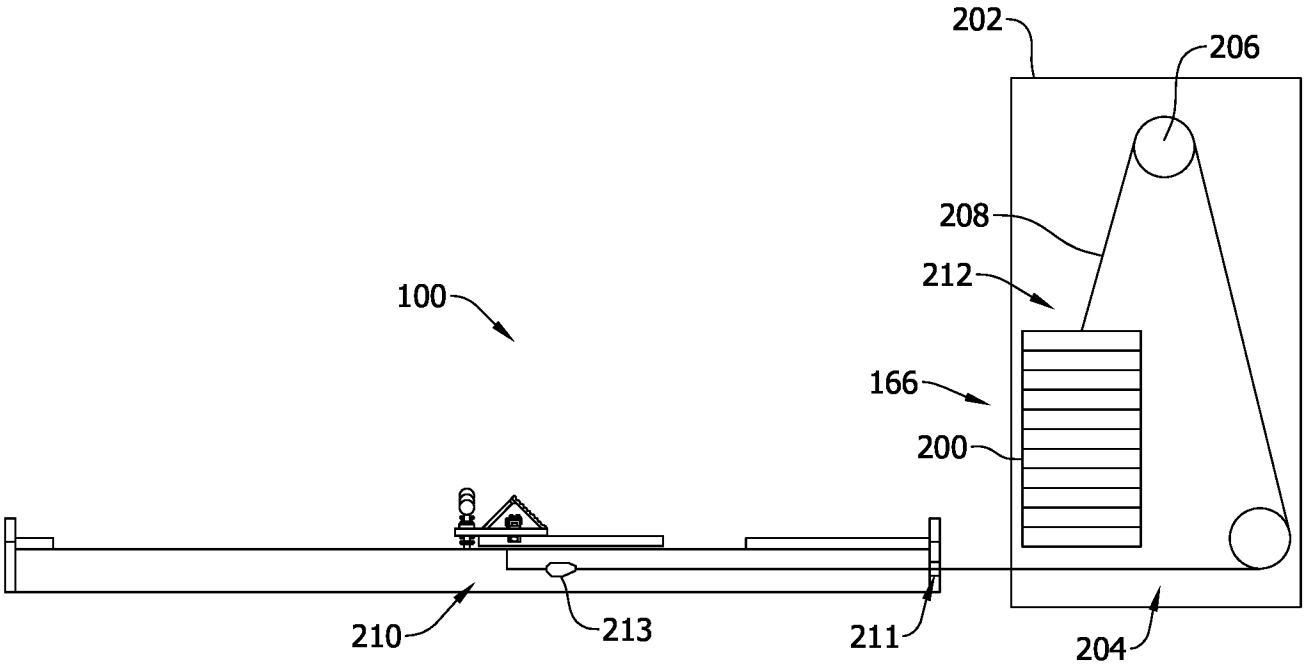
FIG. 9 depicts a side view of the exercise apparatus shown in FIG. 1 including alternative resistance members.
Figure 10:
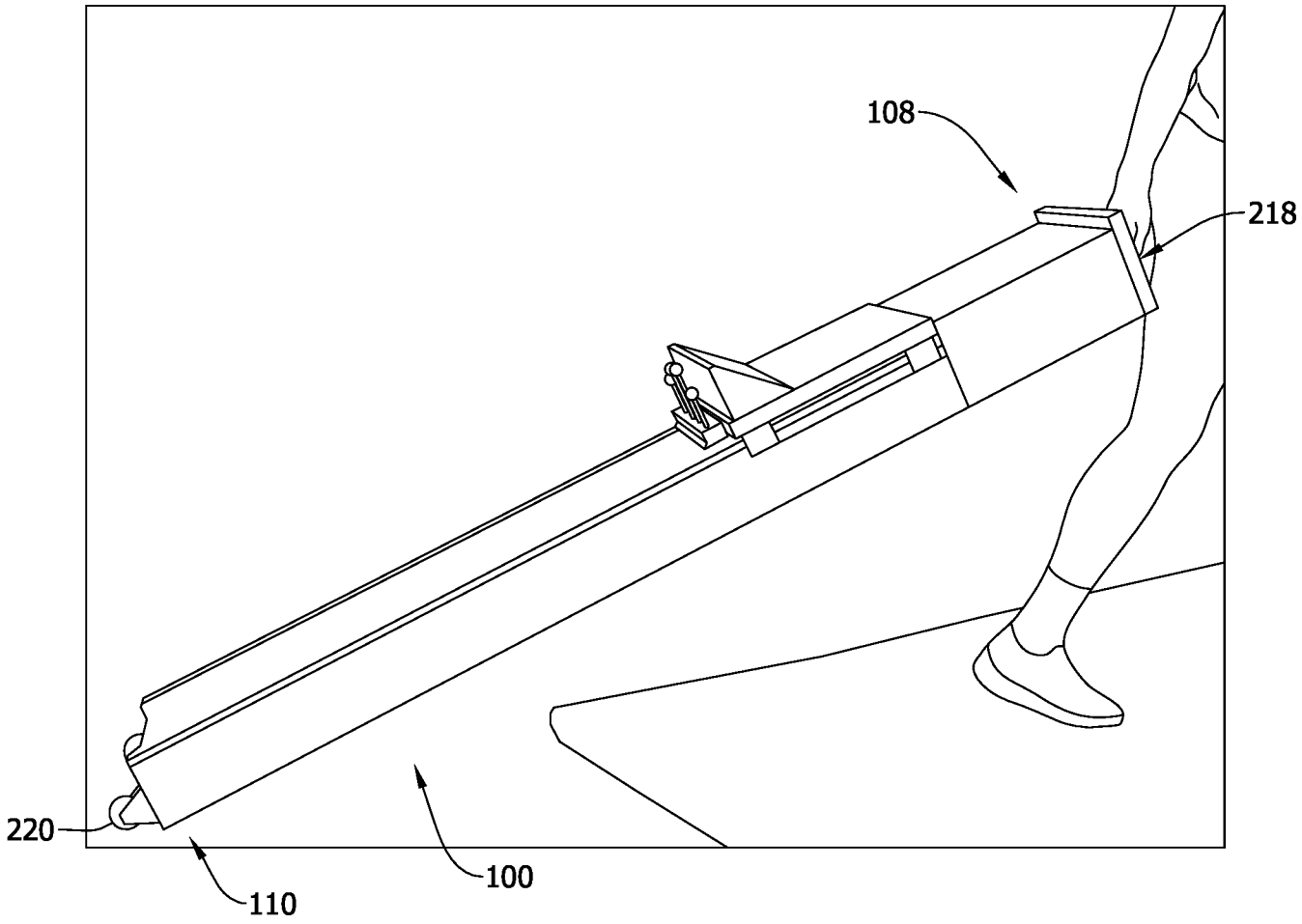
FIG. 10 depicts a side perspective view of the exercise apparatus shown in FIG. 1, including a handle and wheels.

With reference to FIG. 9, the exercise apparatus 100 is shown with an alternative embodiment of the resistance member 166. In particular, the resistance member 166 includes a plurality of resistance members 166, selectively couplable to the slidable foot platform 106. In particular, the resistance members 166 of the embodiment of FIG. 9 are embodied as stacked selectorized weights 200. In some embodiments, the resistance member 166 includes selectorized weights 200 of an external weight machine, such as a dual adjustable cable crossover machine. The resistance member 166 may alternatively include free weights (e.g., couplable to a weight plate connected to a pulley assembly, such as pulley assembly 204). An external housing 202 houses the selectorized weights 200 and a pulley assembly 204. The external housing 202 may form a part of exercise apparatus 100 or may be part of the external weight machine. The pulley assembly 204 includes one or more pulleys 206 and one or more cables 208. In some embodiments, a first end 210 of the pulley assembly 204 (e.g., a first end of the cable 208) is inserted into the base 102 of the exercise apparatus 100 (e.g., through an opening 211 in the second end wall 116) and is selectively couplable to the slidable foot platform 106, such as via a coupler 213 (e.g., a carabiner, hook or other suitable coupler), via one or more rods 180, or with any other suitable coupling assembly/mechanism. The cable 208 is wrapped about the pulleys 206. A second end 212 of the pulley assembly 204 (e.g., a second end of the cable 208) is coupled to a weight plate (not labeled) of the selectorized weights 200 that moves up and down in unison with movement of the slidable foot platform 106. The weight plate is selectively couplable to each weight of the stack of selectorized weights (e.g., by a pin) to vary the resistance imparted on the slidable foot platform 106. The user of the exercise apparatus 100 may selectively adjust how much weight to use in their exercise (e.g., how many of the weights to engage using the cable 208) according to known methods associated with selectorized weight machines. Thereafter, the user may operate the exercise apparatus 100 by moving the slidable foot platform 106 as described herein.

It should be readily understood that the exercise apparatus 100 may include any number of resistance members 166 (e.g., resistance bands 168 or weights 200), including 1, 2, 3, 4, 5, or more resistance members 166, and may therefore include any corresponding number of rods 180 and pulleys 176. Moreover, any number and/or combination of resistance members 166, such as resistance bands 168 or weights 200, may be activated by the user during operation of the exercise apparatus 100, to select and customize the level of resistance and difficulty of their exercise. Each resistance member 166 may have the same elasticity, weight/mass, or other characteristic that defines the resistance that resistance member 166 imparts, and an exercise can increase in resistance/difficulty by activating more resistance members 166. Additionally or alternatively, one or more resistance members 166 may have a different elasticity, weight/mass, or other characteristic that defines the resistance that resistance member 166 imparts, such that selecting/activating each resistance member 166 results in a different level of resistance/difficulty (and increasing resistance/difficulty can be further achieved by activating multiple resistance members 166 simultaneously). It should also be understood that, where the resistance members 166 are not embodied using resistance bands 168, other components that facilitate selectively adjusting the resistance may be implemented, such as one or more knob(s), handle(s), lever(s), dial(s), and/or button(s), for the weight-based, pneumatic, magnetic, spring, pulley, piston, and/or braking resistance.

The exercise apparatus 100 described herein may be implemented in a variety of embodiments without departing from the scope of the present disclosure. In particular, the exercise apparatus 100 may have an overall length (generally corresponding to the length $L_1$ of the side walls 112) from about 26 inches to about 96 inches, an overall width (generally corresponding to the width W of the end walls 114, 116) of about 10 inches to about 40 inches, and an overall height from about 3 inches to about 12 inches (or about 18 inches with a removable sub-platform 162 coupled to the slidable foot platform 106). Even more particularly, the height of the slidable foot platform 106 (that is, the distance between the top surface 152 thereof and a ground surface on which the exercise apparatus 100 is located) may be about 2 inches to about 12 inches. These dimensions may be particularly suitable for a residential-use apparatus that is relatively more portable and accessible. For instance, the height of the foot platforms may be configured for improved safety (e.g., reduced fall risk) and/or flexibility of use (e.g., the ability to perform various exercises with the stationary foot on the ground surface, not the stationary foot platform 104). It is contemplated that a commercial-use apparatus may have other dimensions (e.g., a greater height, such as up to about 34 inches).

In some embodiments, as described herein, the exercise apparatus 100 includes a sub-platform 162 coupled to the slidable foot platform 106, the sub-platform 162 having the coupling assembly 164 and the foot block 158 coupled thereto (or, in some embodiments, integral thereto). This sub-platform 162 may be selectively removable from the slidable foot platform 106 to reduce the overall height of the exercise apparatus 100 when not in use (e.g., to the height $H_2$ of the end walls 114, 116, which may be up to about 5 inches less than the overall height H with the sub-platform 162 coupled to the slidable foot platform 106). The sub-platform 162 may be coupled to/de-coupled from the slidable foot platform 106 using any suitable method/component, including locking cam levers 214 that engage with a track 216 defined in the top surface 152 of the slidable foot platform 106, or in any other suitable manner. Moreover, the exercise apparatus 100 may include a handle 218 and/or wheels 220 at opposing ends 108, 110 thereof (see FIG. 9), which improve the portability and usability of the exercise apparatus 100.

The base 102, stationary foot platform 104, and/or slidable foot platform 106 may each be independently formed from any suitable material, such as molded plastic/polymer, steel, aluminum, wood, metal, composite material, and the like. Moreover, in some embodiments, the stationary foot platform 104 and/or the slidable foot platform 106 include, as the top surface 126 and/or 152 thereof, a material (e.g., a grip tape) or textured pattern having a relatively high coefficient of friction to increase or improve frictional engagement between these foot platform(s) 104/106 and the user's feet. The materials used to form any part of the exercise apparatus 100 may be selected based upon a use environment of the exercise apparatus 100, such as residential use (in which lighter-weight and/or less expensive materials may be selected) vs. commercial use (in which materials that can withstand greater levels of use but that are heavier and/or more expensive may be used).

Figure 11:
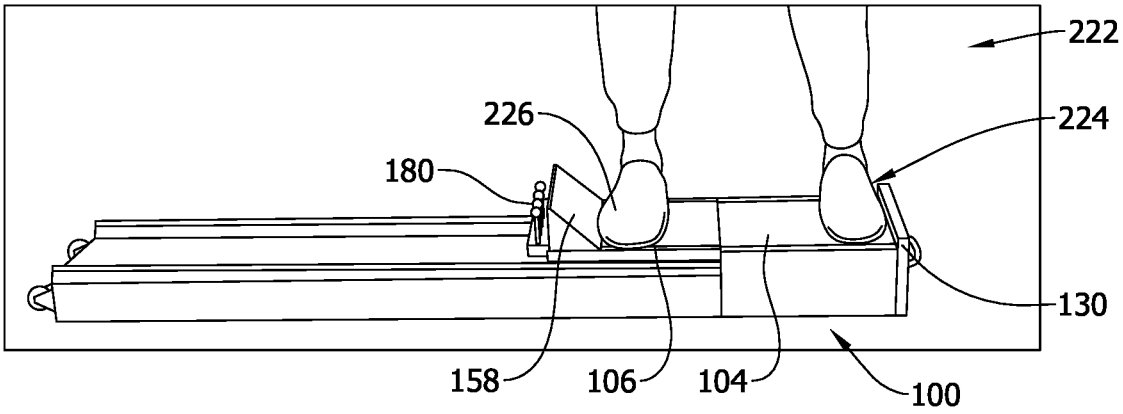
FIGS. 11-14 depict operation of the exercise apparatus shown in FIG. 1.
Figure 12:
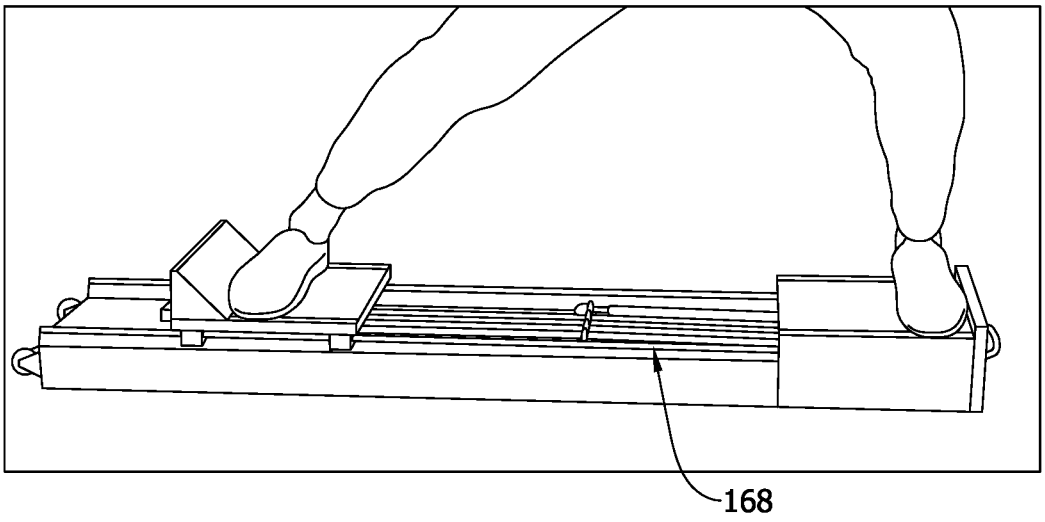
Figure 13:
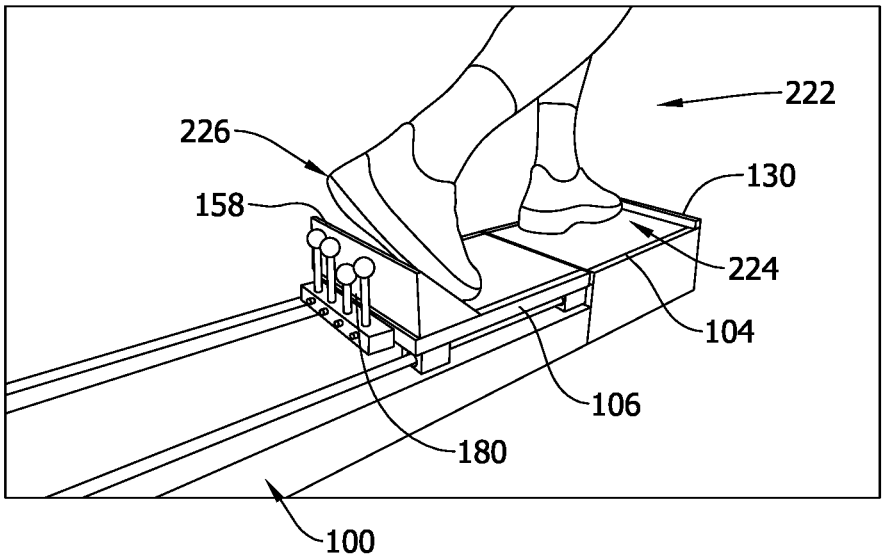
Figure 14:
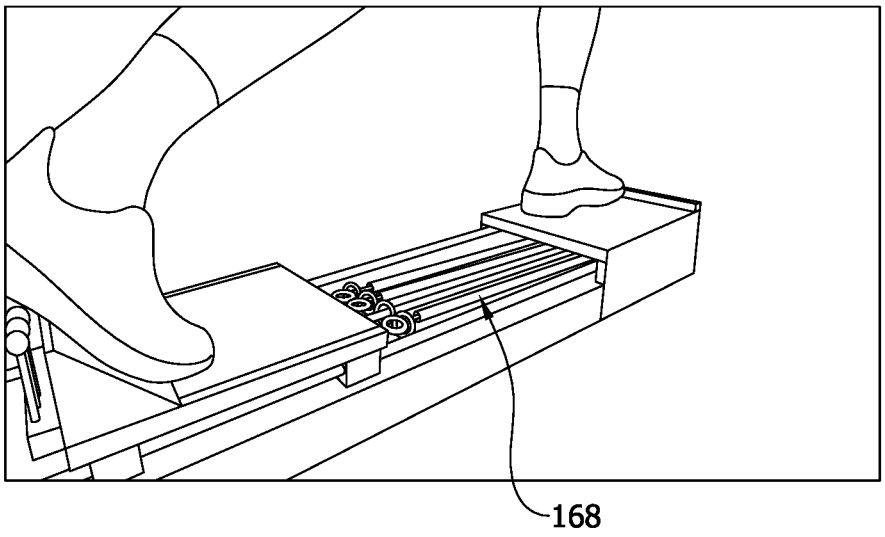

Turning to FIGS. 11-14, operation of the exercise apparatus 100 is depicted. More particularly, FIGS. 11 and 12 depict operation of the exercise apparatus 100 for targeted activation of the lateral gluteal muscles, and FIGS. 13 and 14 depict operation of the exercise apparatus 100 for targeted activation of the posterior gluteal muscles.

With respect to FIGS. 11 and 12, a user 222 is first positioned on the exercise apparatus 100 with their stationary or non-active foot 224 on the stationary foot platform 104 and their active foot 226 on the slidable foot platform 106. The slidable foot platform 106 is in the first position, and the active foot 226 is positioned laterally adjacent to or "side-by-side" with respect to the non-active foot 224. Before or after the user 222 is in this position, the user 222 may select their desired level of resistance described herein, such as by manipulating one or more rods 180 to select one or more resistance bands 168 (not shown in FIG. 11) for activation.

The user 222 engages their active foot 226 against the top surface 152 (see FIG. 1) of the slidable foot platform 106 and/or against the inclined surface 160 (see FIG. 1) of the foot block 158, and braces their non-active foot 224 against the top surface 126 (see FIG. 1) of the stationary foot platform 104 and/or against the lip 130. The user 222 pushes the slidable foot platform 106 away from the stationary foot platform 104, from the first position, as shown in FIG. 11, to a second, extended position, as shown in FIG. 12, using a lateral motion with their active foot 226. The resistance member(s) 166 (e.g., resistance bands 168) exert a resistive force on the slidable foot platform 106 as the slidable foot platform 106 is translated from the first position to the second, engaged position, increasing the engagement/activation of the user's muscles. The user 222 then reverses the motion of their active foot 226, allowing resistive force on the slidable foot platform 106 to return the slidable foot platform 106 to the first position (while maintaining some amount of force on the slidable foot platform 106, through the active foot 226). The user 222 may repeat these motions any number of times.

With respect to FIGS. 13 and 14, a user 222 is first positioned on the exercise apparatus 100 with their stationary or non-active foot 224 on the stationary foot platform 104 and their active foot 226 on the slidable foot platform 106. The slidable foot platform 106 is in the first position, and the active foot 226 is positioned behind or posteriorly to the non-active foot 224. Before or after the user 222 is in this position, the user 222 may select their desired level of resistance described herein, such as by manipulating one or more rods 180 to select one or more resistance bands 168 (shown in FIG. 13) for activation.

The user 222 engages their active foot 226 against the top surface 152 (see FIG. 1) of the slidable foot platform 106 and/or against the inclined surface 160 (see FIG. 1) of the foot block 158, and braces their non-active foot 224 against the top surface 126 (see FIG. 1) of the stationary foot platform 104 and/or against the lip 130. The user 222 pushes the slidable foot platform 106 away from the stationary foot platform 104, from the first position, as shown in FIG. 13, to a second, extended position, as shown in FIG. 14, using a backwards motion with their active foot 226. The resistance member(s) 166 (e.g., resistance bands 168) exert a resistive force on the slidable foot platform 106 as the slidable foot platform 106 is translated from the first position to the second, engaged position, increasing the engagement/activation of the user's muscles. The user 222 then reverses the motion of their active foot 226, allowing resistive force on the slidable foot platform 106 to return the slidable foot platform 106 to the first position (while maintaining some amount of force on the slidable foot platform 106, through the active foot 226). The user 222 may repeat these motions any number of times.

Figure 15:
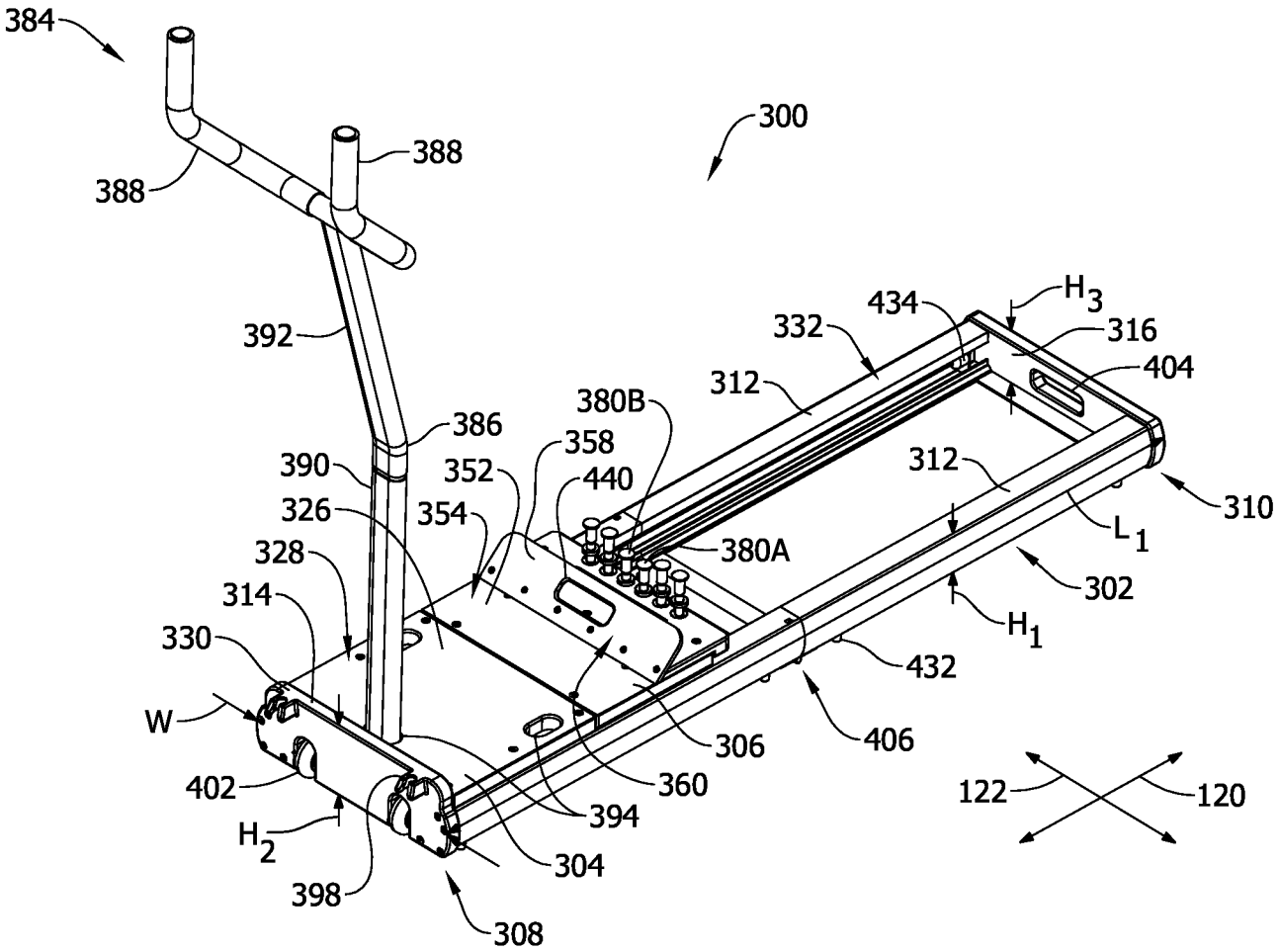
FIG. 15 is a perspective view of another exemplary exercise apparatus.

FIG. 15 is a perspective view of another exemplary exercise apparatus 300. Unless otherwise noted, the exercise apparatus 300 is substantially similar to and functions in substantially the same manner as the exercise apparatus 100. The exercise apparatus 300 generally includes a base 302, a stationary or fixed foot platform 304 fixedly coupled to the base 302, and a moveable or slidable foot platform 306 that is slidable with respect to the base 302 and the stationary foot platform 304. In the illustrated embodiment, the base 302 extends from a first end 308 to a second end 310 (also referred to as a first end 308 and second end 310, respectively, of the exercise apparatus 300) and includes a pair of side walls 312, a pair of end walls 314, 316, and a bottom wall or bottom panel 318 (see FIGS. 17 and 20). The side walls 312 extend parallel to one another in the longitudinal direction 120, from the first end 308 to the second end 310 of the base 302, and perpendicular to the end walls 314, 316, which extend parallel to one another in the transverse or lateral direction 122.

The side walls 312 each have a first height $H_1$ measured from a bottom to a top of each side wall 312. In the exemplary embodiment, the side walls 312 are rectangular, such that the first height $H_1$ is constant along an entire length $L_1$ of the side walls 312, and the side walls 312 are generally sized and shaped the same as one another. The first end wall 314 has a second height $H_2$ measured from a bottom to a top of the first end wall 314 and is substantially rectangular, such that the second height $H_2$ is generally constant along an entire width W of the first end wall 314 (although the first end wall 314 may have curved or sloped corners, as shown in FIG. 15). The second end wall 316 has a third height $H_3$ measured from a bottom to a top of the second end wall 316 and is substantially rectangular, such that the third height $H_3$ is generally constant along the entire width W of the second end wall 316 (although the second end wall 316 may have curved or sloped corners, as shown in FIG. 15). The width W of the first and second end walls 314, 316 is substantially equal, and may be referred to as the width W of the base 302 and/or of the exercise apparatus 300. In the exemplary embodiment, the third height $H_3$ of the second end wall 316 is substantially equal to the first height $H_1$ of the side walls 312, and the second height $H_2$ is greater than the first height $H_1$ and the third height $H_3$, such that the first end wall 314 is taller than the side walls 312 and the second end wall 316. The bottom panel 318 of the base 302 is coupled between the side walls 312 at the first end 308 of the base 302. The bottom panel 318 is also coupled to the first end wall 314 (e.g., to an interior surface thereof, not shown). The bottom panel 318 has a second length $L_2$ (see FIG. 20) that is less than $L_1$.

The stationary foot platform 304 is coupled to the base 302 at the first end 308 thereof. Specifically, the stationary foot platform 304 is coupled to the first end wall 314 and to both side walls 312. The stationary foot platform 304, side walls 312, bottom panel 318, and first end wall 314 collectively define a chamber 324 (see FIG. 17) at the first end 308 of the exercise apparatus 300. The stationary foot platform 304 is planar, and a top surface 326 thereof defines a support surface 328 for a user's foot (e.g., a "stationary" foot).

Figure 16:
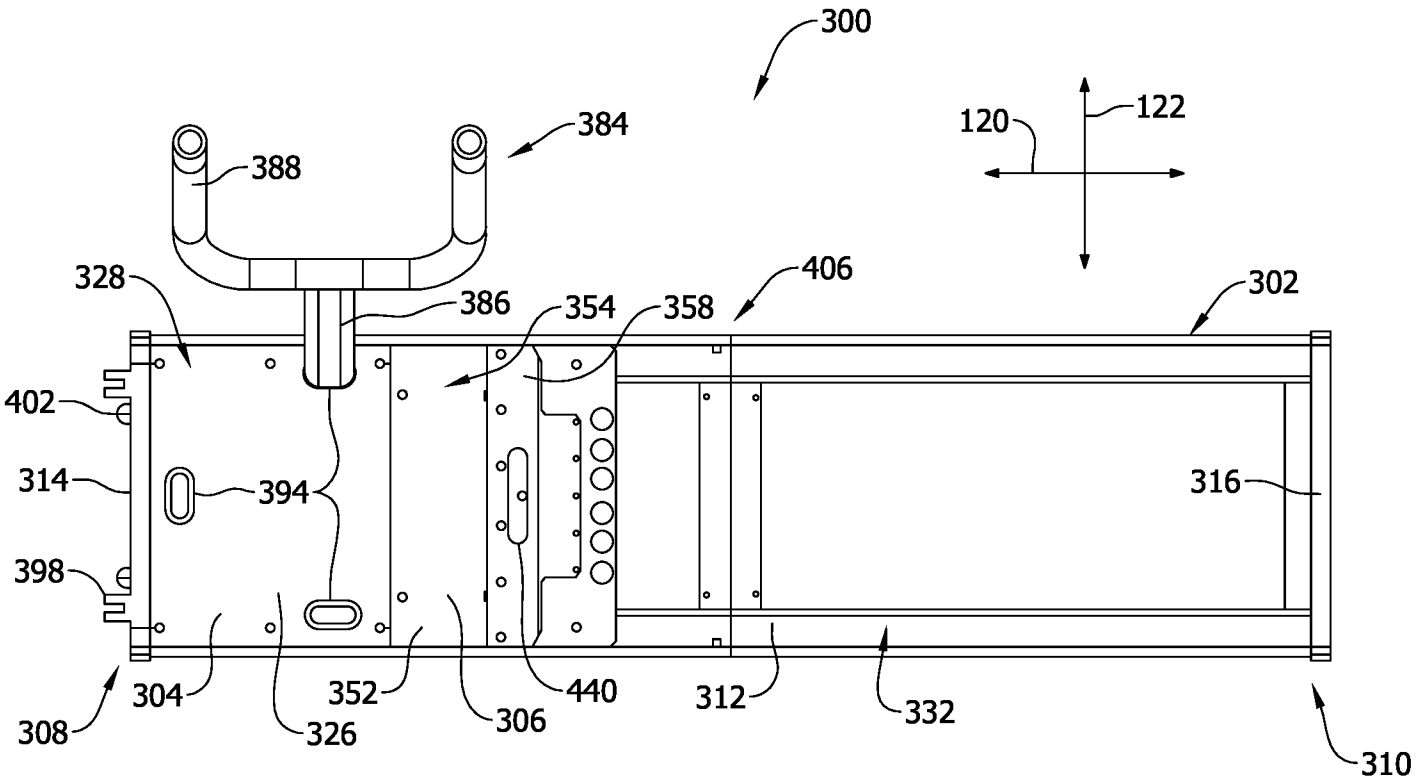
FIG. 16 is a top view of the exercise apparatus shown in FIG. 15.

In the exemplary embodiment, the exercise apparatus 300 further includes a stabilizing handle 384 that is selectively and removably couplable to the base 302. The stabilizing handle 384 includes a column 386 and a pair of handlebars 388 extending from the column 386. The stabilizing handle 384 is configured to enhance a user's stability during operation of the exercise apparatus 300. In the illustrated embodiment, the column 386 includes a bottom section 390 and a top section 392 that is oriented at an oblique angle with respect to the bottom section 390, which may enhance the positioning of the user while engaging the stabilizing handle 384 (e.g., while grasping the handlebars 388). In other embodiments, however, the column 386 may be straight, or may include more than two sections angled with respect to one another. The top surface 326 of the stationary foot platform 304 defines at least one receiving hole 394 for receiving the column 386 of the stabilizing handle 384 therein. In the exemplary embodiment, the top surface 326 defines three receiving holes 394 therein, one at an end of the top surface 326 proximate to the first end wall 314, and two at opposing sides of the top surface 326 proximate to the side walls 312. Accordingly, the stabilizing handle 384 may be selectively coupled to the base 302 in three positions, two of which are shown in FIGS. 15 and 16. Each of the receiving holes 394 is sized and shaped complementary to a cross-sectional shape of the column 386. In the illustrated embodiment, each receiving hole 394 is shaped oblong or as an elongated circle (also referred to as "racetrack" or "pill" shaped). Additionally, in the illustrated embodiment, the receiving hole 394 positioned proximate to the first end wall 314 is oriented parallel to the lateral direction 122, and the two other receiving holes 394 are oriented parallel to longitudinal direction 120.

In addition, the exercise apparatus 300 includes at least one receiving seat 396 (see FIGS. 17 and 20) for receiving the column 386 of the stabilizing handle 384 therein. In particular, the exercise apparatus 300 includes a respective receiving seat 396 vertically aligned with each receiving hole 394. In the exemplary embodiment, there are three receiving seats 396 corresponding to the three receiving holes 394. One receiving seat 396 is coupled to an interior surface (not shown) of bottom panel 318, and two receiving seats 396 are coupled to an interior bottom surface (not shown) of side walls 312. The receiving seats 396 are shaped and sized complementary to a shape and size of the column 386 of the stabilizing handle 384, such that the receiving seats 396 engage the column 386 with a friction fit, to enhance the connection between the stabilizing handle 384 and the base 302 of the exercise apparatus 300.

It should be readily understood that the stationary foot platform 304 may have fewer, additional, or alternatively positioned receiving holes 394 defined therein, and/or that the exercise apparatus 300 may likewise include fewer, additional, or alternatively positioned receiving seats 396 corresponding to the receiving holes 394.

In the exemplary embodiment, the first end wall 314 extends above the top surface 326 of the stationary foot platform 304, and defines an upwardly extending lip 330 at the first end 308 of the exercise apparatus 300. The lip 330 further defines the support surface 328 and is configured to brace the user's stationary foot during use of the exercise apparatus 300. Additionally, the first end wall 314 includes at least one exercise band anchor 398 extending from the lip 330. In the illustrated embodiment, the first end wall 314 includes two such band anchors 398, which extend rearwardly from the first end wall 314 (e.g., away from the stationary foot platform 304). The band anchors 398 are configured to receive and anchor respective ends of resistance bands (also referred to as exercise bands, resistance/exercise cords, etc.), enabling the use of the exercise apparatus 300 to perform additional, alternative, or supplemental strength training during use thereof (e.g., to incorporate upper-body strength training exercises).

Although the lip 330 and the band anchors 398 are defined by the first end wall 314 in the illustrated embodiment, it is contemplated that, in alternative embodiments, the lip 330 and/or the band anchors 398 may be separate components coupled to and/or extending upwardly from the top surface 326 of the stationary foot platform 304.

Additionally, in the exemplary embodiment, the exercise apparatus 300 includes wheels 402 at the first end 308, which extend at least partially through the first end wall 314. At the opposite, second end 310 of the exercise apparatus 300, a handle 404 is defined in the second end wall 316. For example, the handle 404 is embodied as an opening or slot through the second end wall 316. The handle 404 and wheels 402 enhance the portability and usability of the exercise apparatus 300.

Figure 19:
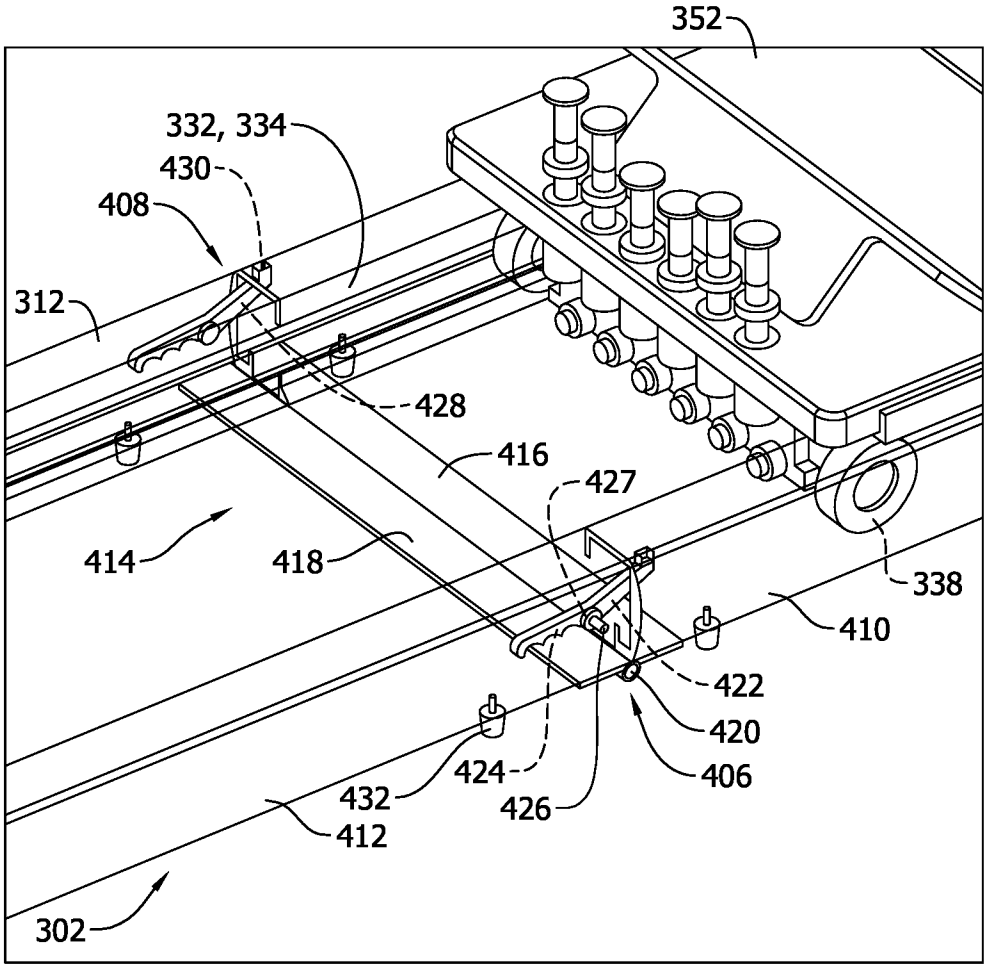
FIG. 19 is an enlarged perspective view depicting a hinge assembly of the exercise apparatus shown in FIG. 15.
Figure 22:
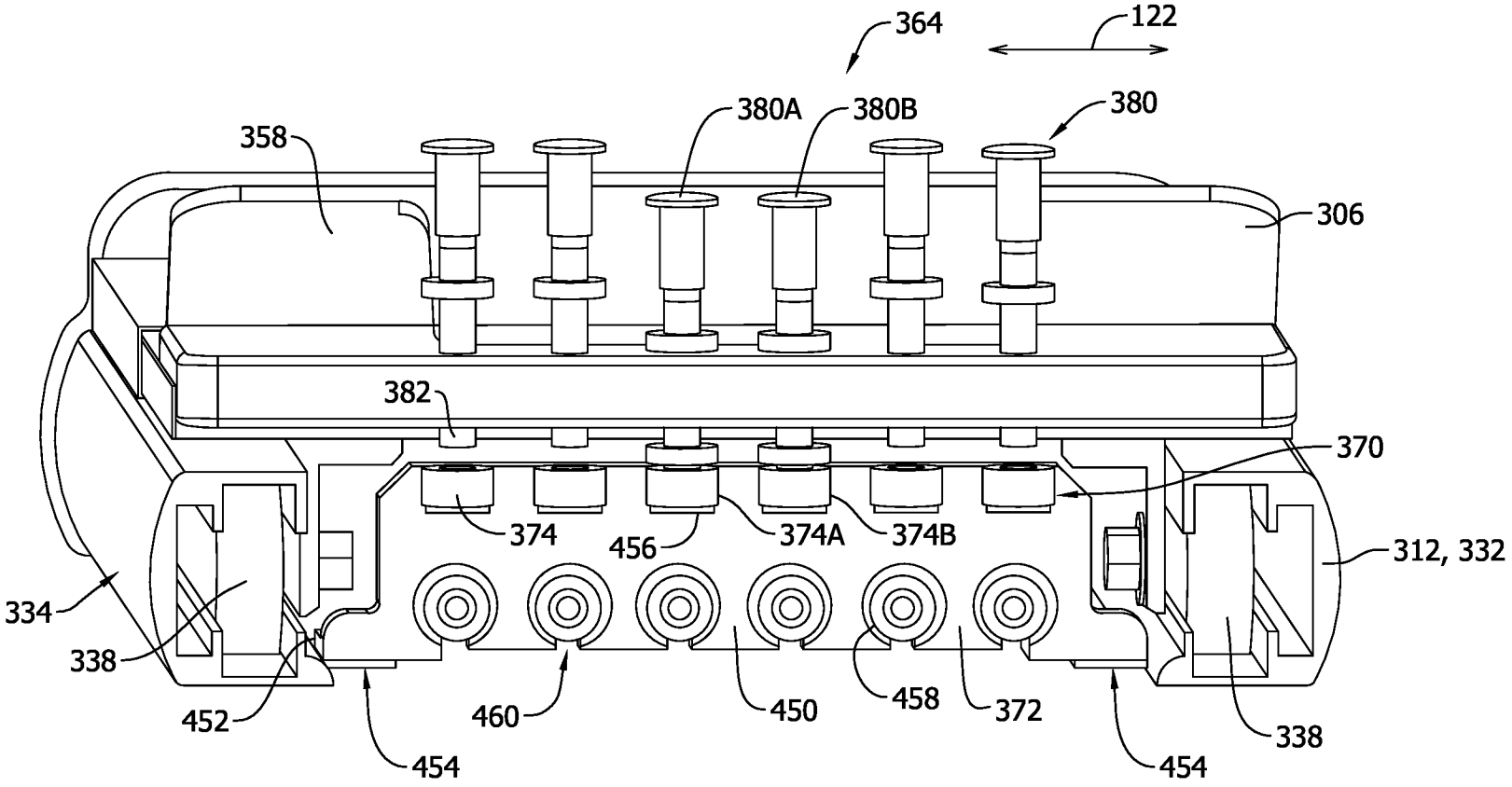
FIG. 22 is a sectional view depicting a coupling assembly of the exercise apparatus shown in FIG. 15.
Figure 23:
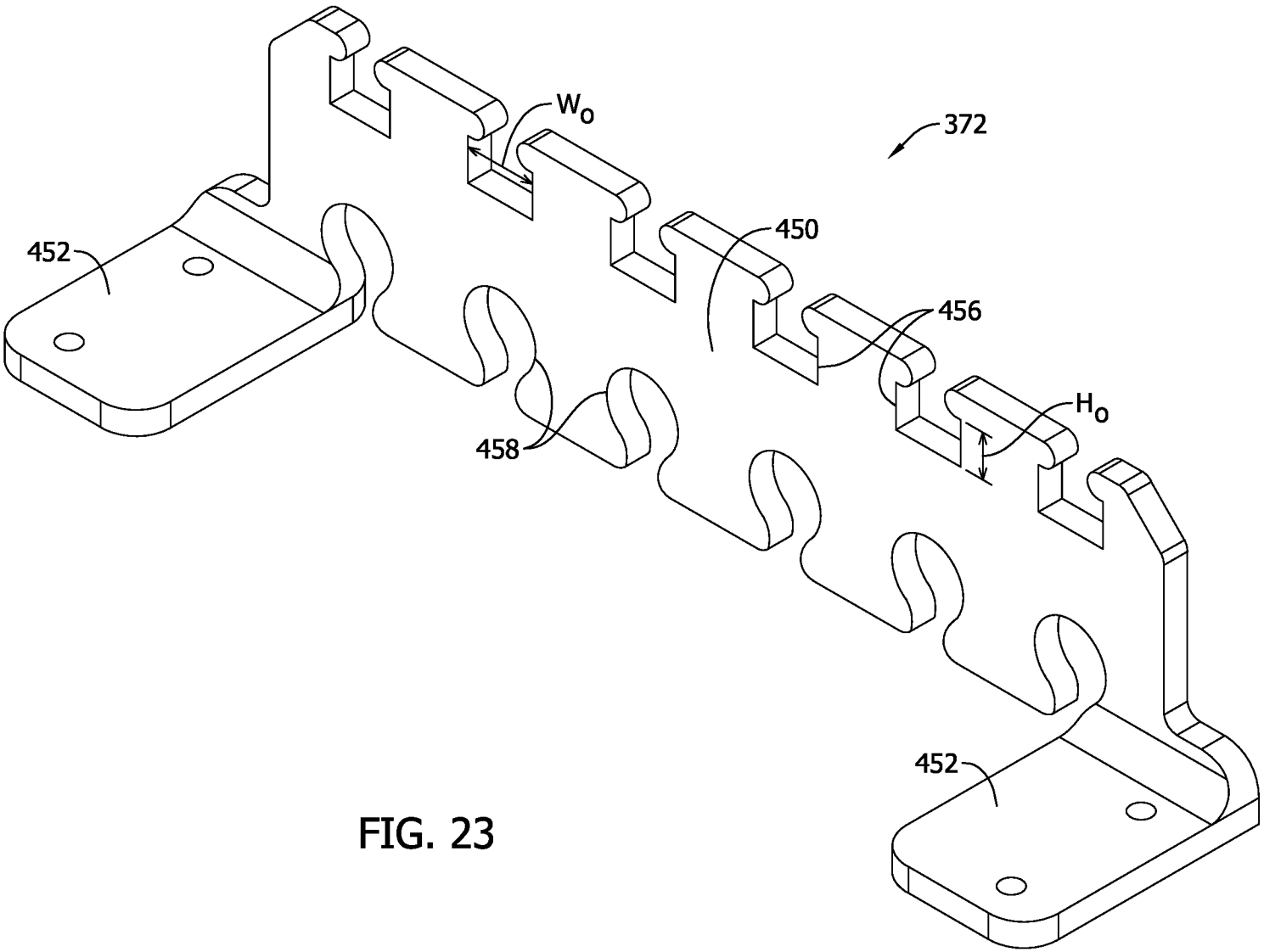
FIG. 23 is a perspective view of an anchoring bracket of the coupling assembly shown in FIG. 22.
Figure 24:
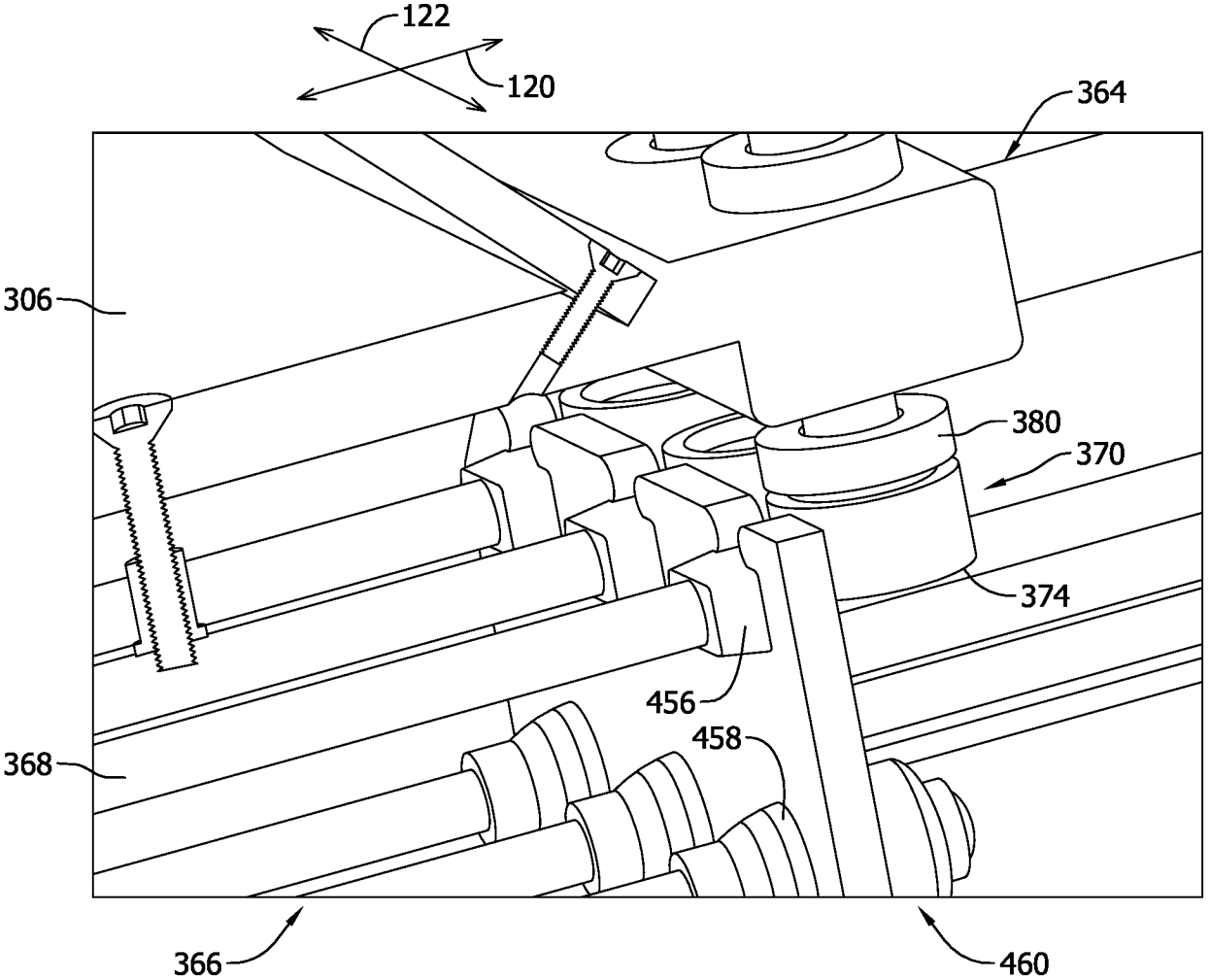
FIG. 24 is a side sectional view of the coupling assembly shown in FIG. 22.
Figure 25:
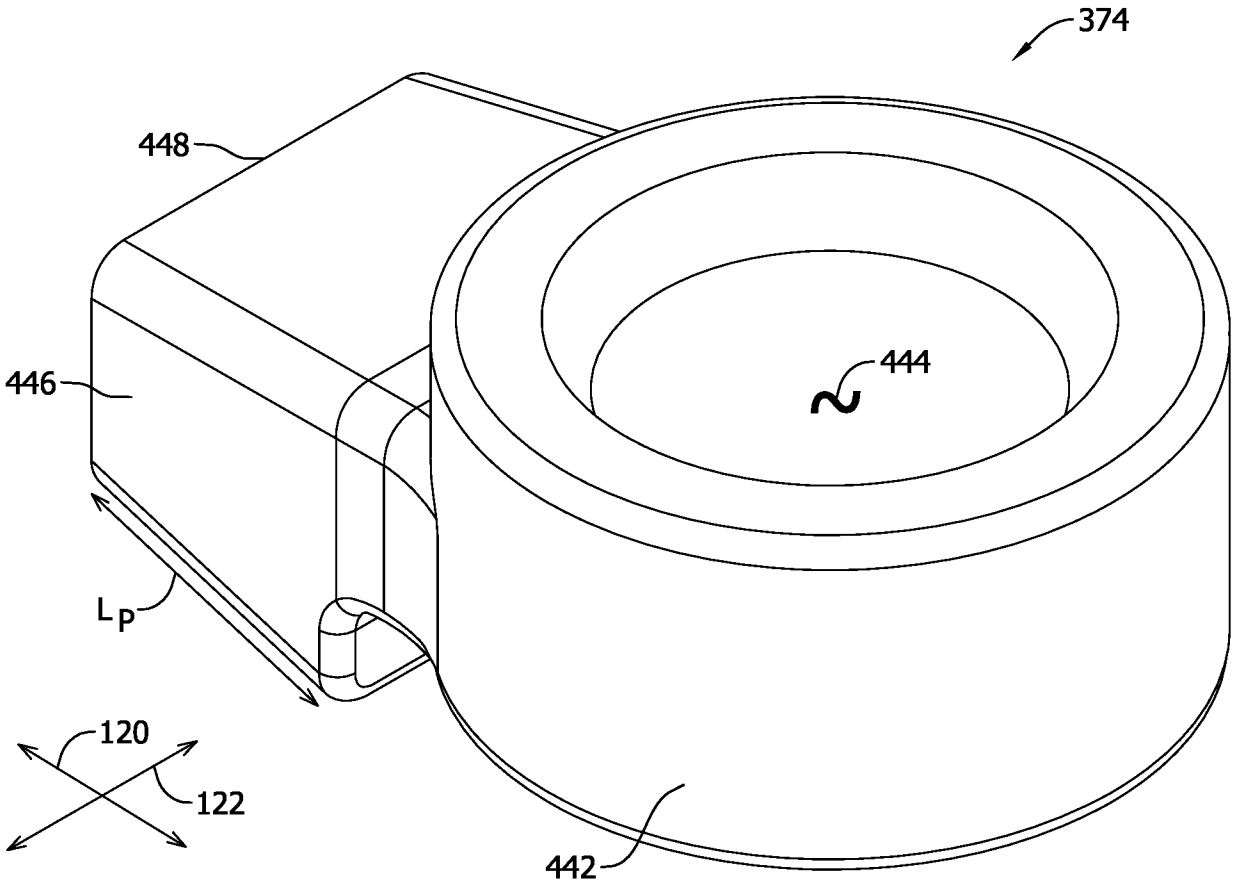
FIG. 25 is a perspective view of a resistance member end link suitable for use with the coupling assembly shown in FIG. 22.
Figure 26:
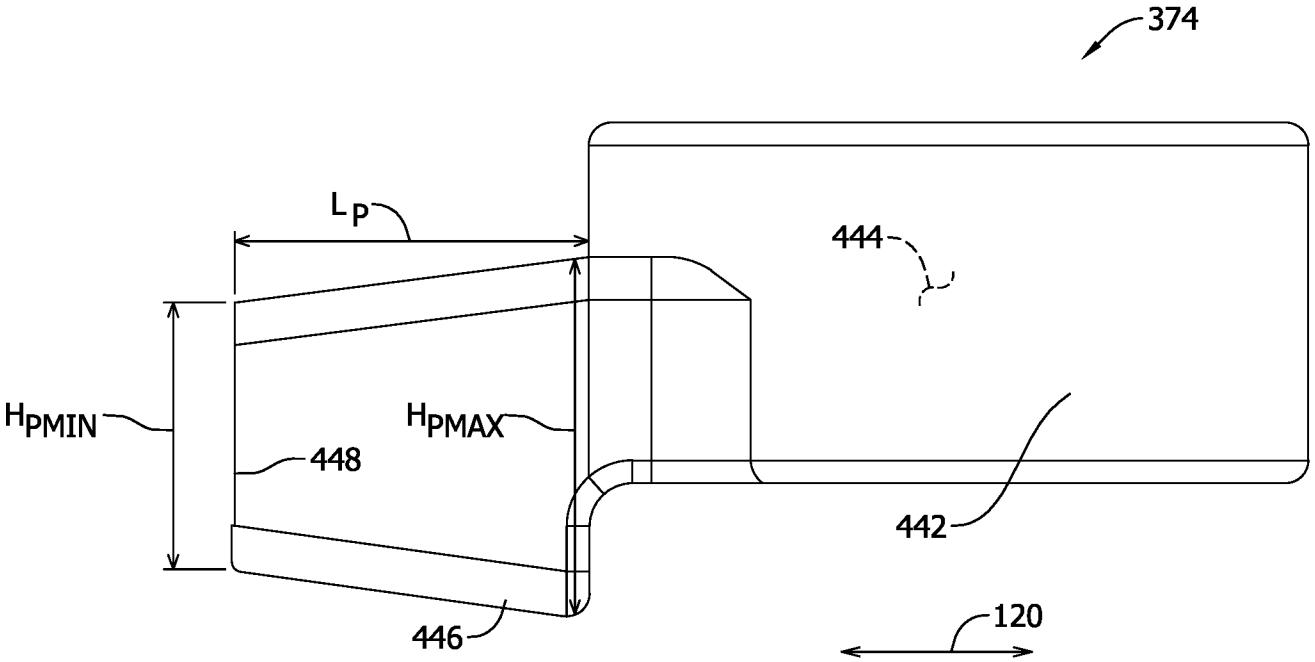
FIG. 26 is a side view of the resistance member end link shown in FIG. 25.
Figure 27:
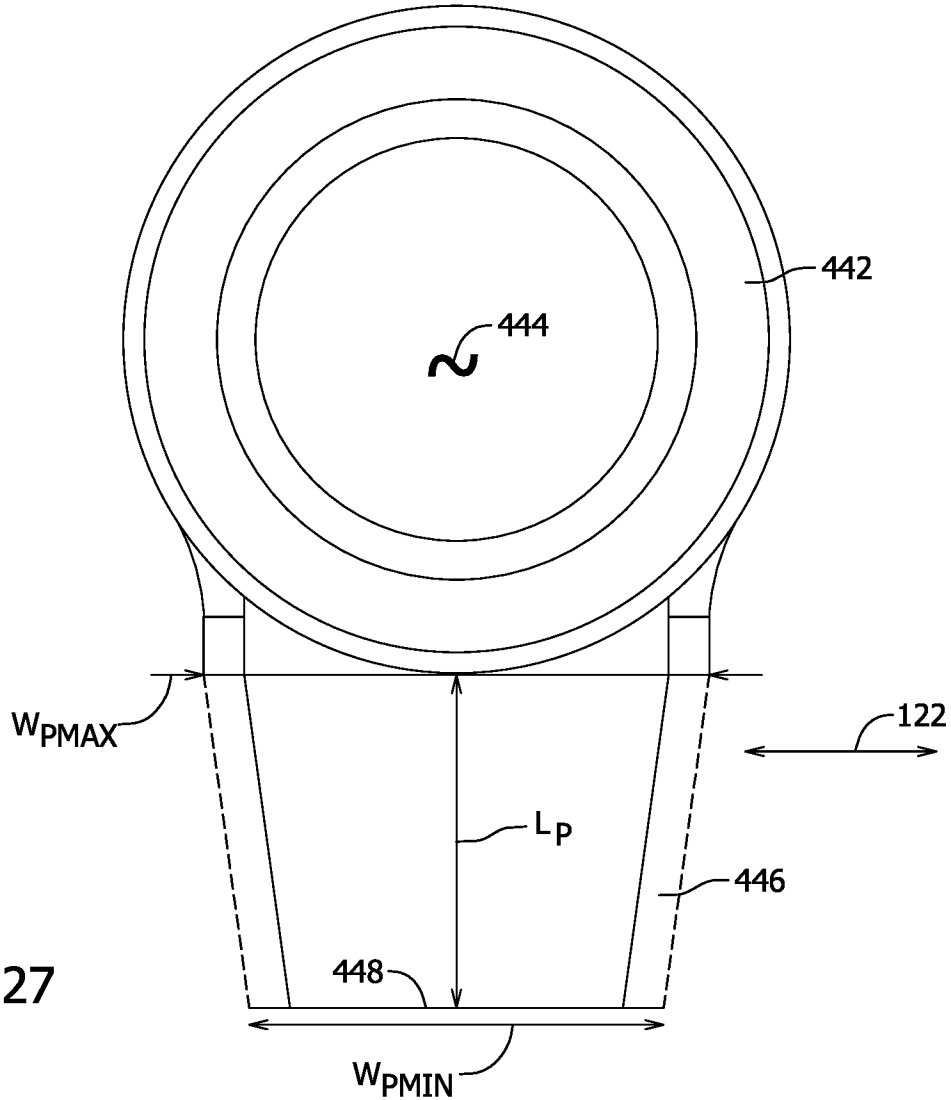
FIG. 27 is a top view of the resistance member end link shown in FIG. 25.

The base 302 further includes a pair of linear tracks 332 that extend parallel to one another in the longitudinal direction 120, which also defines a direction of movement of the slidable foot platform 306. Specifically, the slidable foot platform 306 is mounted to the tracks 332 and is movable relative thereto between a first or initial position and a second, extended position. In some embodiments, as best shown in FIGS. 19 and 22, the tracks 332 are embodied as a pair of C-shaped tracks 334 defined by the side walls 312. A plurality of wheels 338 are coupled to the slidable foot platform 306 (e.g., via a plurality of brackets 340), and each of the wheels 338 is positioned within one of the C-shaped tracks 334. As the slidable foot platform 306 is moved in the longitudinal direction 120, the wheels 338 rotate, allowing the slidable foot platform 306 to move smoothly along the tracks 334.

Figure 20:
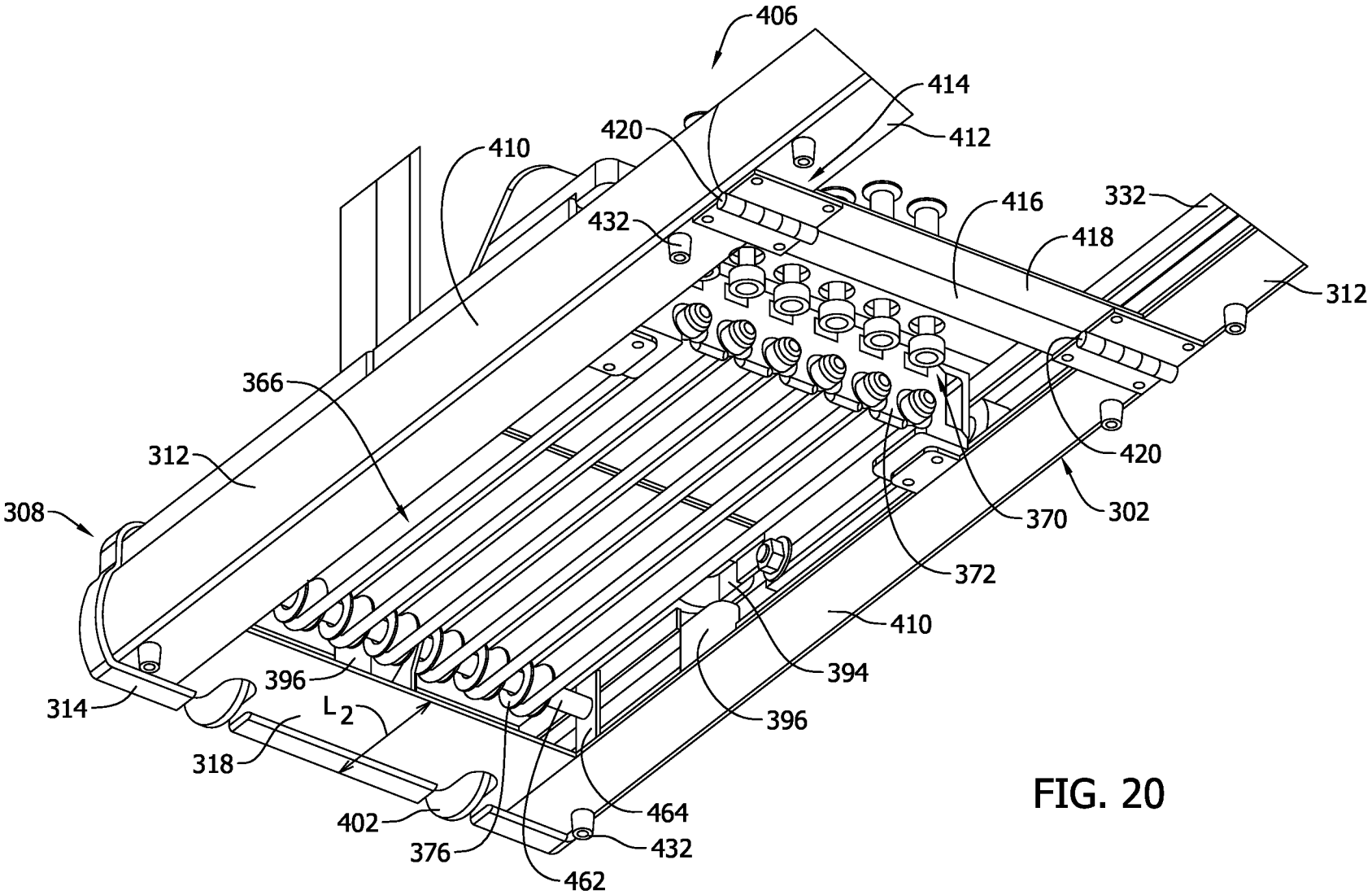
FIG. 20 is a perspective view depicting a bottom of the exercise apparatus shown in FIG. 15.
Figure 21:
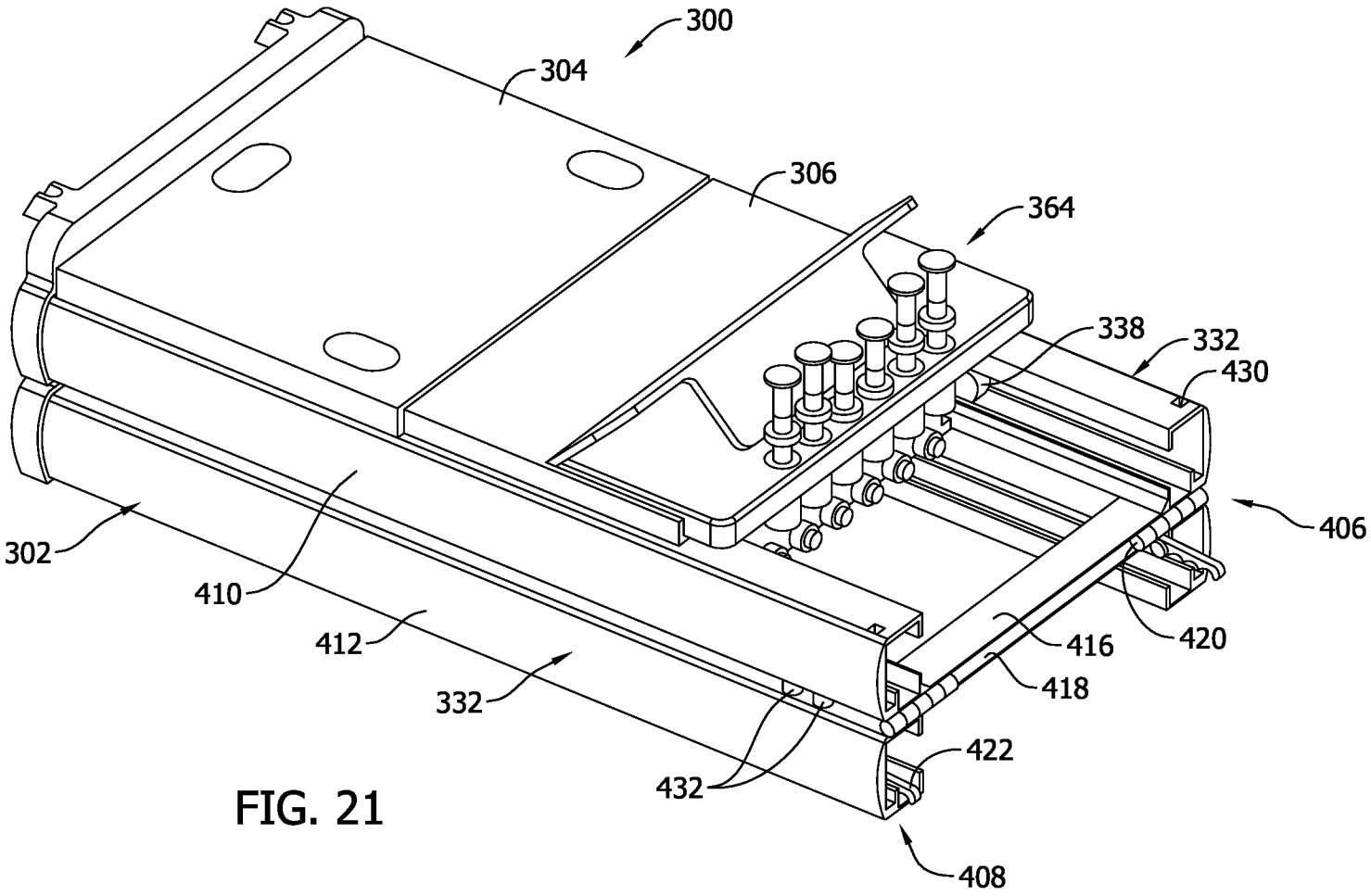
FIG. 21 is a perspective view depicting the exercise apparatus shown in FIG. 15 in a folded configuration.

In the exemplary embodiment, as best shown in FIGS. 19-21, the exercise apparatus 300 includes a hinge assembly 406 that enables a user to selectively transition the exercise apparatus 300 between an operational configuration (shown, for example, in FIGS. 15 and 16) and a folded or stowed configuration (shown in FIG. 21). The tracks 332 each define a respective plane of separation 408 approximately halfway between the first end 308 and the second end 310 of the base 302, such that each track 332 includes a first portion 410 and a second portion 412 delineated by the plane of separation 408. The hinge assembly 406 includes a hinge 414 defined by a pair of hinge plates 416, 418 and a pair of rods 420 hingedly coupling the hinge plates 416, 418 together (see FIG. 20). The first hinge plate 416 spans the width W of the exercise apparatus 300 and is coupled to the first portions 410 of the tracks 332 (e.g., via one or more fasteners, adhesive, welding, etc.), and the second hinge plate 418 spans the width W of the exercise apparatus 300 and is coupled to the second portions 412 of the tracks 332. The hinge 414 defines a pivot axis about which the first and second portions 410, 412 of the tracks 332 rotate relative to one another, to transition the exercise apparatus 300 between the operational configuration and the folded configuration.

As shown in FIG. 19, the hinge assembly 406 also includes a pair of clips 422 disposed within the tracks 332. Specifically, in the exemplary embodiment, one clip 422 is respectively disposed within each of the tracks 332. In some embodiments, the hinge assembly 406 includes only one such clip 422. Each clip 422 is coupled to an interior surface (not labeled) of one of the first portion 410 or the second portion 412 of the respective track 322, via a pivot pin 426 (e.g., at a first end 424 of the clip 422). A spring 427 (e.g., a torsion spring) is disposed about the pivot pin 426 and coupled to the clip 422 to bias the clip 422 into a closed position, as shown in FIG. 19. In the closed position, a second end 428 of the clip 422 is engaged with a clip seat 430 defined in the other of the first portion 410 or the second portion 412 of the respective track 332. That is, in the closed position, the clip 422 spans across the respective plane of separation 408 of the track 332, to maintain the track 322 in a linear, extended configuration (e.g., to maintain the exercise apparatus 300 in the operational configuration). To transition the exercise apparatus 300 to the folded configuration, a user may reach into the opening of the C-shaped track(s) 332 and depress the first end 424 of the clip 422, which disengages the second end 428 of the clip 422 from the clip seat 430. Thereby, the tracks 332 are able to fold about the pivot axis of the hinge 414. It is contemplated that alternative hinge assemblies, including alternative components for coupling the first and second portions 410, 412 of the tracks 332 together, may be implemented without departing from the scope of the present disclosure.

In the exemplary embodiment, the exercise apparatus 300 also includes a plurality of feet 432 coupled to the base 302. In the illustrated embodiment, the feet 432 are coupled to the tracks 332. The feet 432 may be coupled to the first portion 410 of the tracks 332 and/or to the second portion 412 of the tracks 332. The feet 432, implemented as rubber feet in the exemplary embodiment, provide additional support for the tracks 332 when the exercise apparatus 300 is in the operational configuration. Additionally, the feet 432 may function as a mechanical stop when transitioning the exercise apparatus into the folded configuration, preventing inadvertent contact between the bottom surfaces of the tracks 332.

With reference now to FIGS. 15, 18, and 22-27, the slidable foot platform 306 of the exemplary embodiment is planar, and a top surface 352 thereof defines a support surface 354 for a user's foot. The slidable foot platform 306 is selectively moveable, relative to the base 302 and the stationary foot platform 304, along the tracks 332 between a first or initial position in which the slidable foot platform 306 is adjacent to the stationary foot platform 304 (shown in FIG. 15), and a second, extended position in which the slidable foot platform 306 is translated along the tracks 332 away from the stationary foot platform 304 (see FIG. 18). The slidable foot platform 306 may be moved any distance from the stationary foot platform 304 up until the tracks 332 terminate at the second end 310 of the base 302 or the second end wall 316, at which position the slidable foot platform 306 is at its fully extended second position and is unable to translate further. In some embodiments, a mechanical stop (e.g., mechanical stop 156) is provided before the second end wall 316, to prevent repeated contact between the slidable foot platform 306 and the second end wall 316. In this embodiment, a mechanical stop is implemented as a pair of bumpers 434 (also referred to as dampers or shock absorbers, see FIG. 15) coupled to the second end wall 316 and the tracks 332 (only one shown in FIG. 15).

A foot block 358, also referred to herein as a foot plate, is coupled to the top surface 352 of the slidable foot platform 306 and extends the support surface 354 thereof. Specifically, the foot block 358 has an inclined (support) surface 360 for engagement with the user's foot (e.g., an "active" foot). The inclined surface 360 is oriented at an oblique angle relative to the top surface 352 of the slidable foot platform 306. In addition, the foot plate 358 has an opening or handle 440 defined therethrough. This handle 440 enables use of the exercise apparatus 300 for upper-body exercises as well as lower-body exercises. For example, the user of the exercise apparatus 300 may grasp the handle 440 and operate (e.g., extend) the slidable foot platform 306 with their arm(s), in various motions or orientations, to perform various upper-body exercises, core exercises, or full-body exercises.

The exercise apparatus 300 further includes at least one resistance member 366 selectively couplable to the slidable foot platform 306 to selectively adjust a resistance or force imparted on the slidable foot platform 306 during operation of the exercise apparatus 300. As shown in FIGS. 15, 18, and 22-27, in the exemplary embodiment, the resistance member 366 includes a plurality of resistance members 366, each selectively couplable to the slidable foot platform 306 independently of one another. In particular, the resistance members 366 of the exemplary embodiment are embodied as elastic resistance bands 368 (e.g., six resistance bands 368). The resistance bands 368 are selectively couplable to the slidable foot platform 306 to selectively adjust (i.e., increase or decrease) the resistance applied to the slidable foot platform 306 during operation of the exercise apparatus 300. This selective coupling is enabled using a coupling assembly 364, which is coupled to or otherwise associated with the slidable foot platform 306.

In the exemplary embodiment, first ends 370 of the resistance bands 368 are retained at an initial position by a bracket 372. The first end 370 of each resistance band 368 includes an end link 374 (also referred to herein as a ring or loop) coupled thereto. In the exemplary embodiment, these end links 374 are rigid, and each end link 374 is capable of withstanding a tensile force at least as great as the maximum resistive force of the resistance band 368 to which it is coupled without deformation of the end link 374. As shown in greater detail in FIGS. 25-27, each end link 374 includes a body 442 defining a through-hole 444, which is configured to receive a respective rod 380 therein (as described in further detail herein), and a post 446 coupled to and extending from the body 442. The post 446 has a tapered or overall trapezoidal shape that narrows as the post 446 extends away from the body 442. More specifically, the post 446 has a height that varies along a length $L_P$ thereof (e.g., along the longitudinal direction 120, see FIGS. 25 and 26) from a maximum height $H_{PMAX}$, where the post 446 is coupled to the body 442, to a minimum height $H_{PMIN}$, at a free end 448 of the post 446. The post 446 also has a width that varies along the length $L_P$ thereof, from a maximum width $W_{PMAX}$, where the post 446 is coupled to the body 442, to a minimum width $W_{PMIN}$, at the free end 448 of the post 446.

The bracket 372 limits movement of the first ends 370 of the resistance bands 368. More specifically, the bracket 372 engages the end links 374 to ensure that end links 374 are in a predefined position prior to operation of the exercise apparatus 300 and/or when each resistance band 368 is not coupled to the slidable foot platform 306. In the exemplary embodiment, the bracket 372 includes a face plate 450 and a pair of feet 452 (see FIGS. 22 and 23). The feet 452 are coupled to a respective pair of track extensions 454 (shown in FIG. 22) that extend inwardly, in the lateral direction 122, from the tracks 332. The face plate 450 includes a plurality of openings or slots defined therein, including a plurality of first openings 456 and a plurality of second openings 458. The plurality of first openings 456 are configured to receive the first ends 370 of the resistance bands 368 therein. More specifically, each first opening 456 is configured to receive and retain a respective end link 374 therein. The first openings 456 are generally rectangular in shape, and have a height $H_O$ and a width $W_O$. The dimensions of the first openings 456 are selected such that the first opening 456 receives the end link 374 and aligns the end link 374 therein. Specifically, the height $H_O$ is selected to correspond to a value intermediate to heights $H_{PMAX}$ and $H_{PMIN}$ of the post 446, and the width $W_O$ is selected to correspond to a value intermediate to widths $W_{PMAX}$ and $W_{PMIN}$ of the post 446. In this way, the post 446 is aligned in the vertical and lateral directions because the tapering of post 446 as it is received in the first opening 456. Thereby, the correct, predefined position and orientation of the end link 374—specifically, the through-hole 444—can be ensured, each time the end link 374 is received in the respective first opening 456, such that the respective rod 380 is reliably couplable to the end link 374 (see, for example, FIG. 24).

Figure 17:
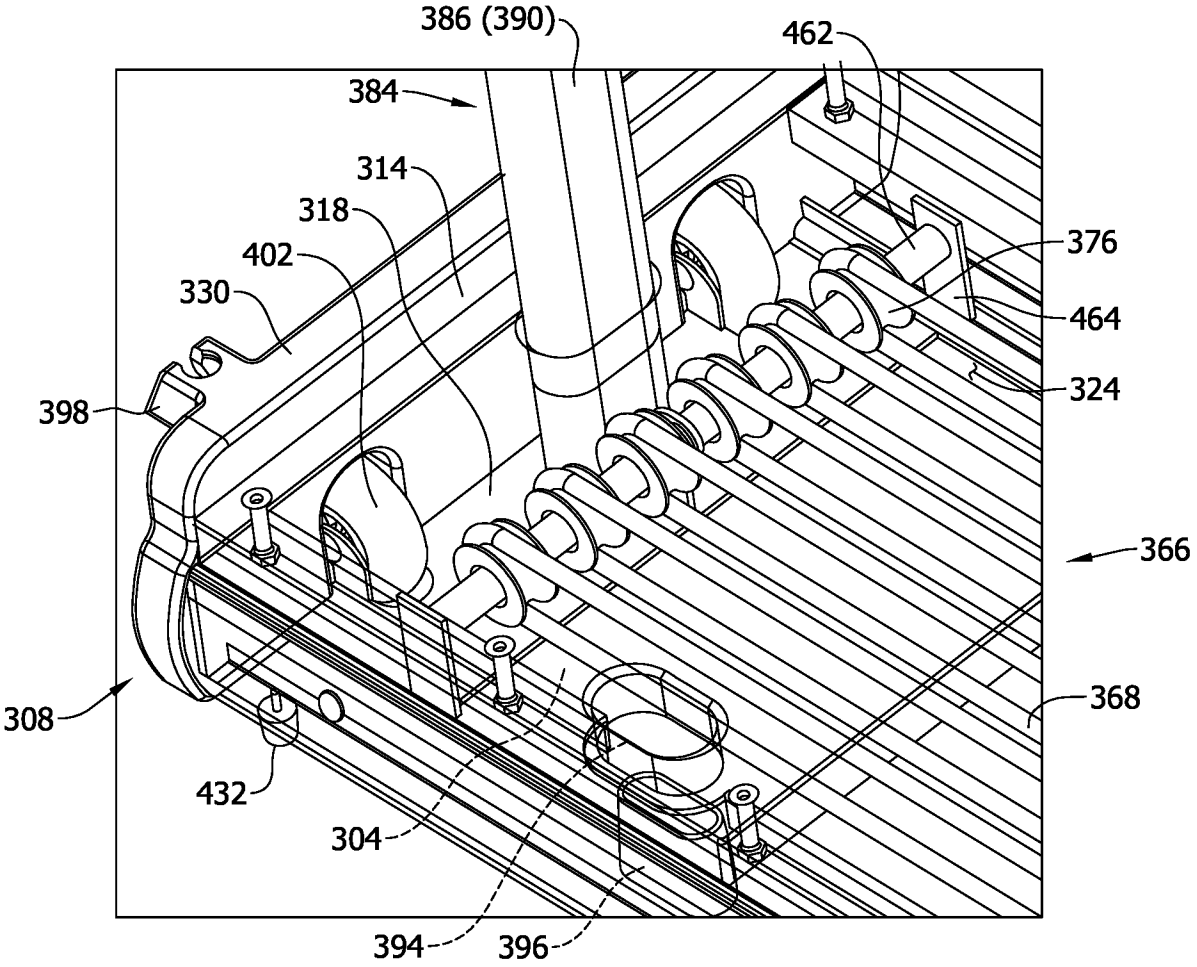
FIG. 17 is an enlarged perspective view depicting a first end of the exercise apparatus shown in FIG. 15.

Additionally, second ends 460 of the resistance bands 368 are also coupled to (e.g., anchored to) the bracket 372. More specifically, the second openings 458 are configured to receive and retain the second ends 460 of the resistance bands 368. In the exemplary embodiment, each resistance band 368 extends from a respective first end 370, around a respective pulley 376 within the base chamber 324, to a respective second end 460. As best seen in FIGS. 17 and 20, a plurality of pulleys 376 (that is, the same number of pulleys 376 as there are resistance bands 368) is coupled to a rod 462 that extends laterally through the chamber 324. In this embodiment, the rod 462 is coupled to a pair of extensions 464 extending vertically from the bottom panel 318. Alternatively, the rod 462 may be coupled to the side walls 312/tracks 332. The pulleys 376 facilitate smooth and even extension of the resistance bands 368 during operation of the exercise apparatus 300. In at least some instances, the second ends 460 of the resistance bands 368 are removably coupled to the bracket 372, such that each band 368 can be individually removed and replaced.

Referring again to FIG. 22, in the exemplary embodiment, the coupling assembly 364 includes a plurality of rods or "push-pins" 380. The rods 380 may be embodied as pins, as depicted in FIG. 22, or may have other structure(s) integrated therewith, such as hooks, flanges, extensions, and the like. In the illustrated embodiment, the exercise apparatus 300 includes the same number of rods 380 as there are resistance bands 368.

Each rod 380 may be selectively actuated from a first position to a second position to engage an end link 374 of corresponding resistance band 368, and may be subsequently actuated from the second position to the first position to disengage the corresponding end link 374. In the illustrated embodiment of FIG. 22, the first position corresponds to a vertically raised position of the rod 380, and the second position corresponds to a lowered or depressed position of the rod 380. Each rod 380 is actuated from the first position to the second position by applying a downward force (e.g., pushing) and depressing the rod 380, and the rod 380 is actuated from the second position to the first position by applying an upward force (e.g., pulling) and raising the rod 380 from the second position to the first position.

Figure 18:
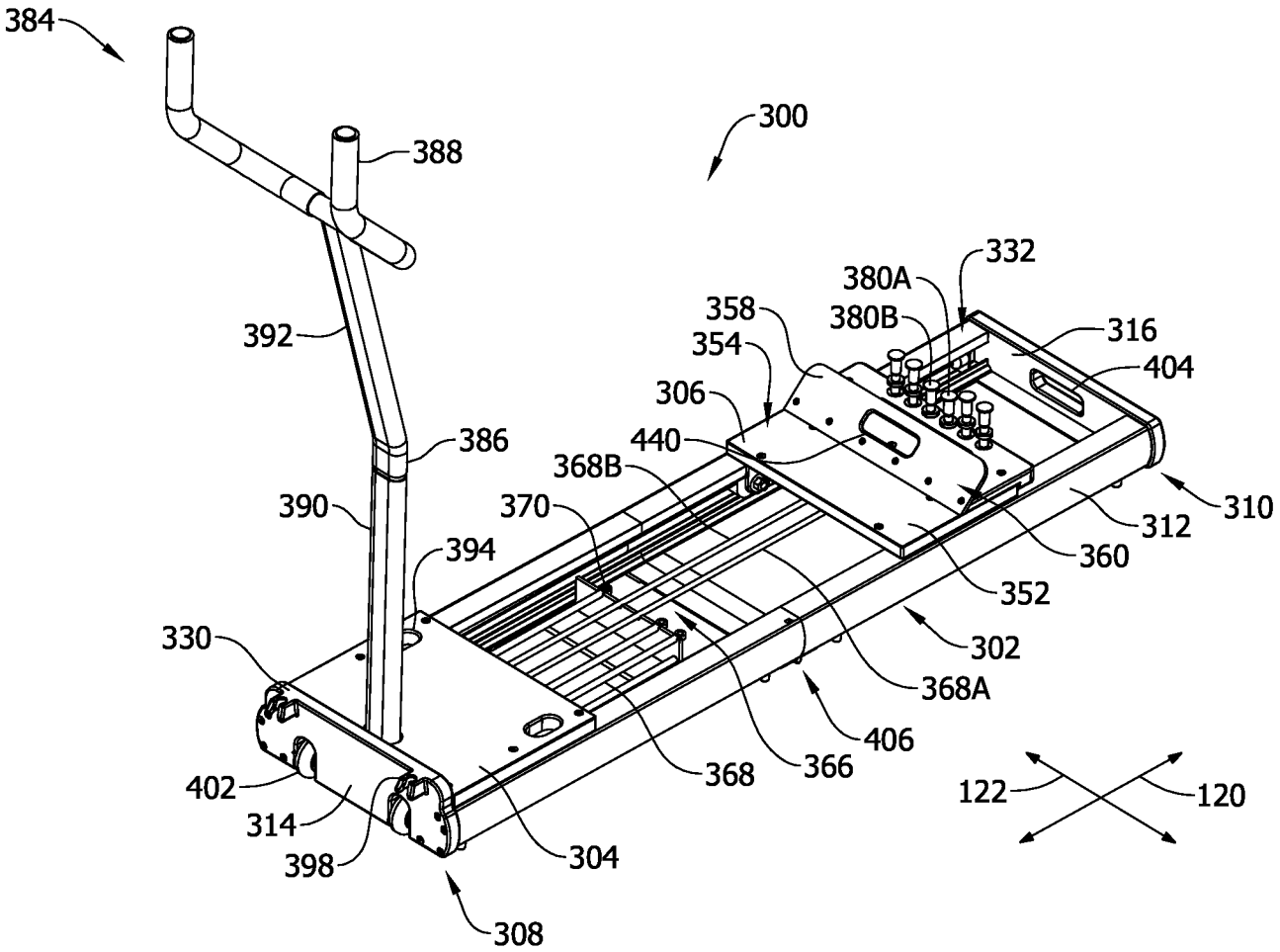
FIG. 18 is a perspective view depicting a slidable foot platform of the exercise apparatus shown in FIG. 15 in an extended position.

When the slidable foot platform 306 is in the first or initial position, the rods 380 are aligned with the end links 374 of the resistance bands 368. The user of the exercise apparatus 300 may depress or lower one or more of the rods 380. When lowered, a free end 382 of the rod 380 is inserted into the end link 374 of the corresponding resistance band 368. In the embodiment of FIGS. 15, 18, and 22, the two middle rods 380A, 380B are lowered and inserted through the end links 374A, 374B of the corresponding two middle resistance bands 368A, 368B. Thereafter, when the user moves the slidable foot platform 306 using their active foot (or using their arms, as described above herein), those corresponding resistance bands 368A, 368B, which are engaged by the lowered rods 380A, 380B, are "activated." That is, those resistance bands 368A, 368B are extended/stretched as the slidable foot platform 306 moves away from the first position to the second, extended position, as shown in FIG. 18, which increases the resistance on the slidable foot platform 306. When the slidable foot platform 306 is returned to the first position, any lowered rod(s) 380 may be raised to disengage those rod(s) 380 from the corresponding resistance band(s) 368.

It should be readily understood that the exercise apparatus 300 may include any number of resistance members 366 (e.g., resistance bands 368), including 1, 2, 3, 4, 5, 6, or more resistance members 366, and may therefore include any corresponding number of rods 380 and pulleys 376. Moreover, any number and/or combination of resistance members 166, such as resistance bands 368, may be activated by the user during operation of the exercise apparatus 300, to select and customize the level of resistance and difficulty of their exercise.

FIGS. 28-31 are perspective views of another embodiment of a coupling assembly 500 suitable for use with the exercise apparatus 100 or the exercise apparatus 300. In the exemplary embodiment, the coupling assembly 500 includes a plurality of rods or "push-pins" 502. Each rod 502 may be selectively actuated from a first position to a second position to engage a loop 504 of a corresponding resistance band 506, and may be subsequently actuated from the second position to the first position to disengage the corresponding loop 504. In the illustrated embodiment of FIGS. 28-31, the first position corresponds to a vertically raised position of the rod 502, and the second position corresponds to a lowered or depressed position of the rod 502.

Figure 28:
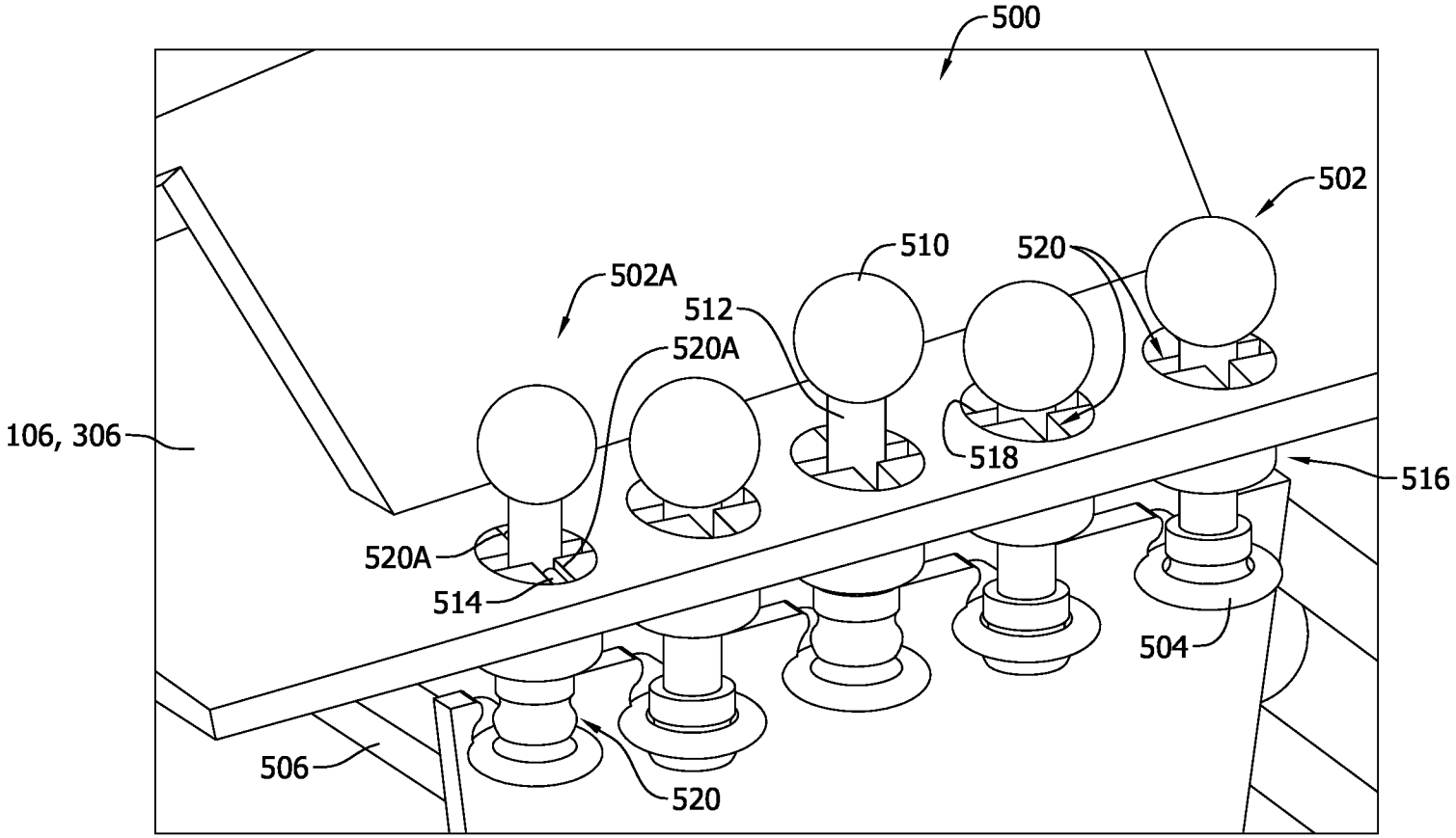
FIGS. 28-31 are perspective views of another embodiment of a coupling assembly suitable for use with the exercise apparatus of FIGS. 1 and 15.
Figure 29:
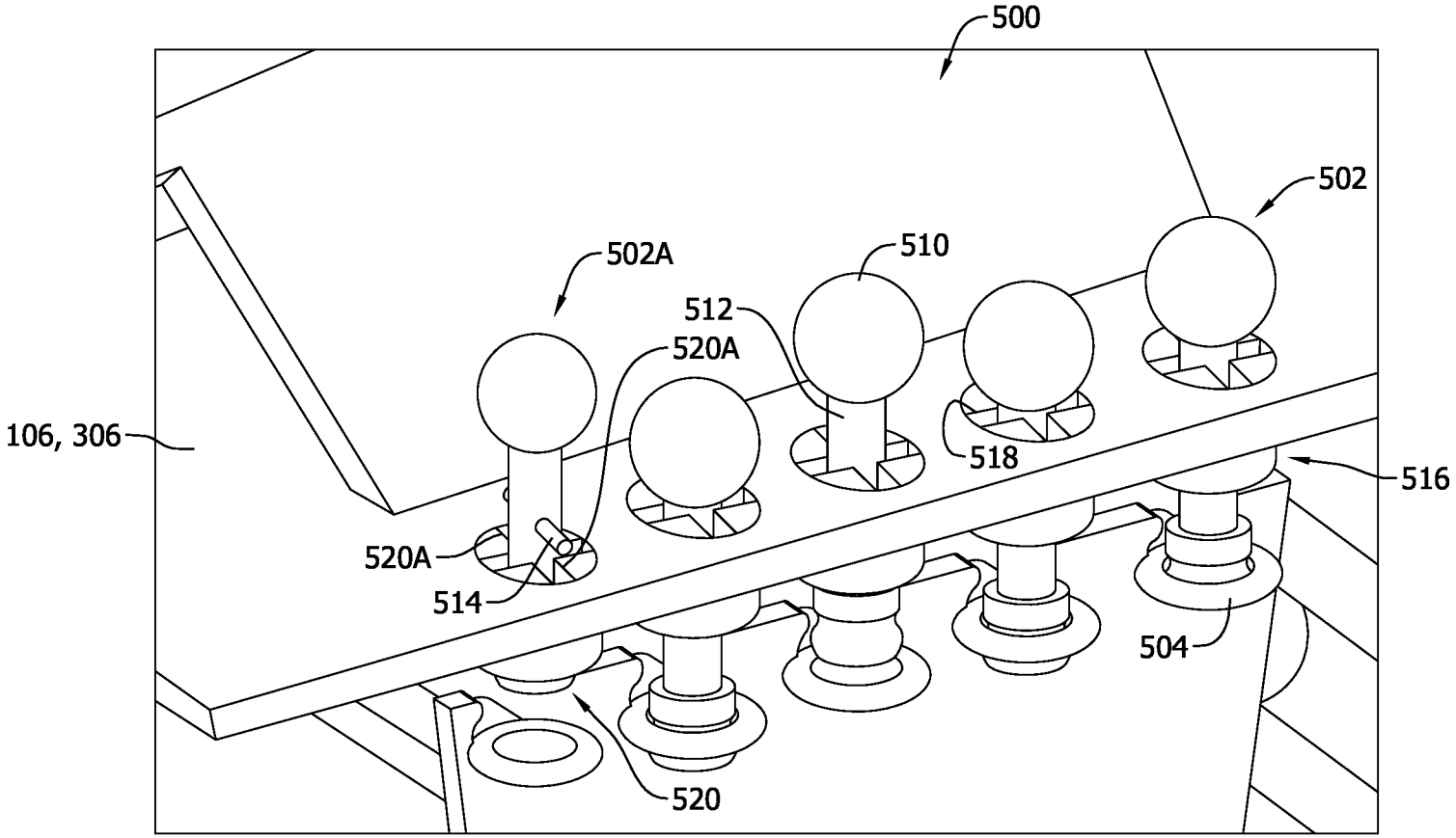

Sequential actuation of the leftmost rod, rod 502A, is depicted in FIGS. 28-31. In particular, the rod 502A is shown in the first, or idle, position in FIG. 28. With reference to FIGS. 28 and 29, each rod 502 includes a ball or handle 510, a shaft 512 extending vertically downwards from the handle 510, and a pair of tabs 514 extending from and perpendicular to the shaft 512. The tabs 514 are oriented on opposite sides of the shaft 512, or approximately 180° from one another, relative to the circumference of the shaft 512.

Each rod 502 extends through a respective channel 516 defined in the slidable foot platform 106/306. The slidable foot platform 106/306 has defined therein a plurality of openings 518 to each channel 516. In the exemplary embodiment, these openings 518 are "cross"- or "x"-shaped openings 518 with four evenly spaced arms 520. Although not shown, a seat is defined in each channel 516. The seat extends radially inward, into the respective channel 516, in alignment with two opposing arms 520A of the opening 518. When the respective rod 502 is in the first position, the tabs 514 contact the seat in the respective channel 516, such that the rod 502 remains in a relatively raised position and a free end 520 of the rod is disengaged from the corresponding loop 504. As depicted in FIGS. 28 and 29, the first position of the rod 502A corresponds not only to its raised position, but also to its relative rotational position, with the tabs 514 rotationally oriented with respect to the opening 518 (specifically, aligned with arms 520A), such that the tabs 514 engage the seat.

Figure 30:
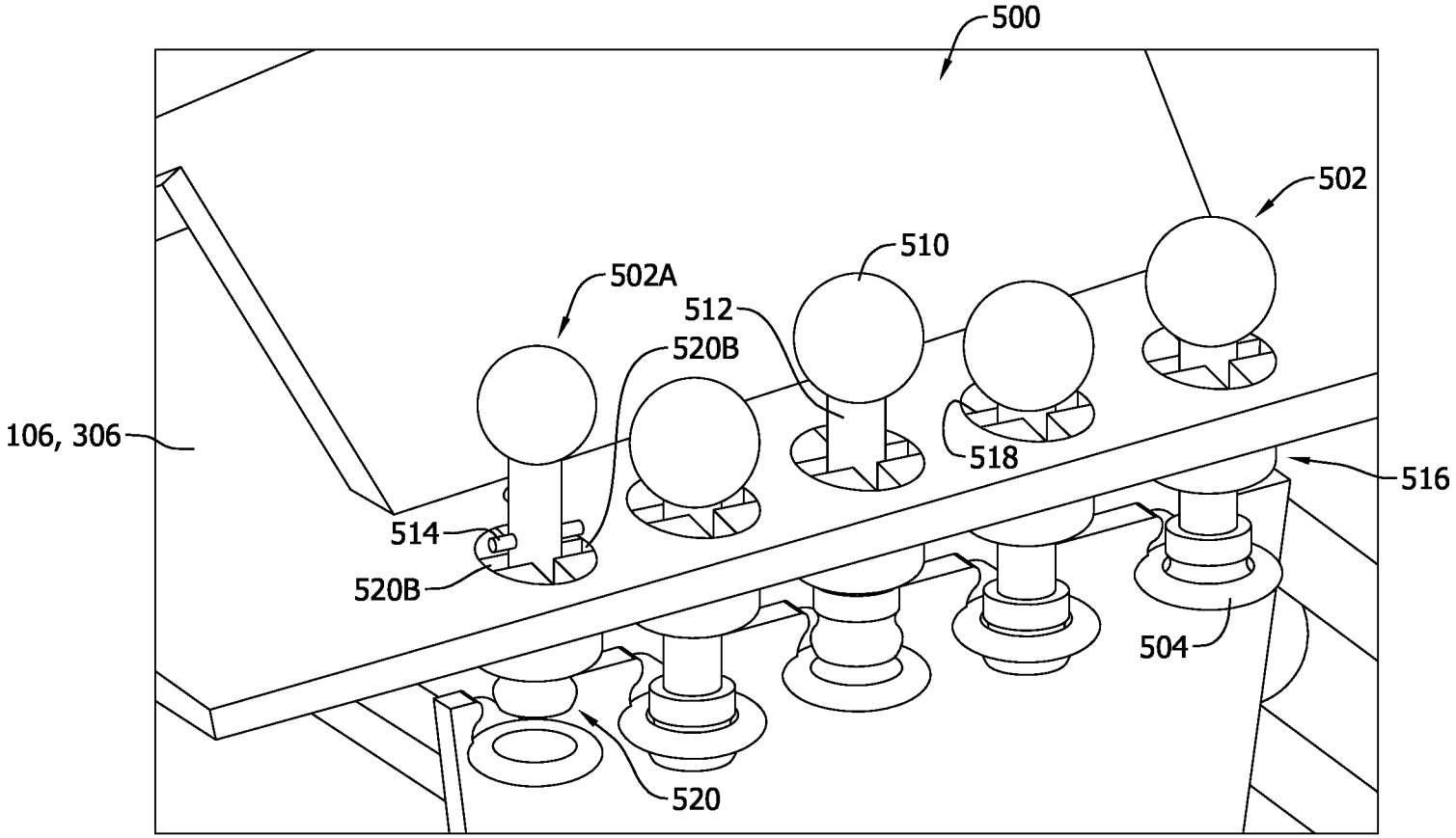
Figure 31:
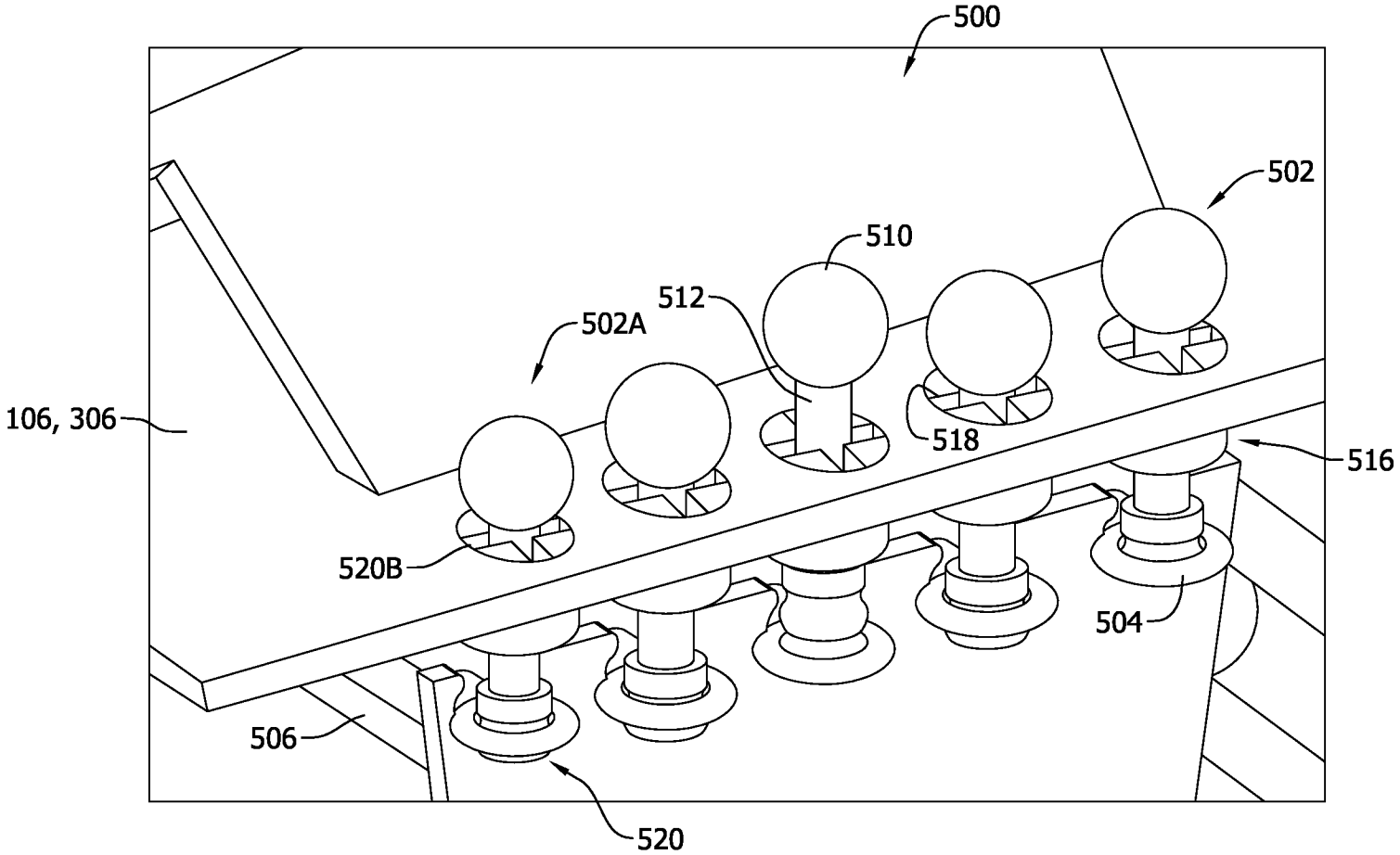

Turning to FIGS. 30 and 31, to selectively transition the rod 502A to the second, engaged position, the rod 502A is raised until the tabs 514 pass through the opening 518. The rod 502A is rotated approximately 90° (e.g., from the rotational orientation depicted in FIG. 29 to the rotational orientation depicted in FIG. 30). The tabs 514 are then aligned with the two other arms 520B of the opening 518. There is no seat defined within the channel 516 that is aligned with these two opposing arms 520B of the opening 518; that is, the channel 516 is axially unobstructed. In this rotational orientation, the rod 502A is lowered into the second position, as depicted in FIG. 31, such that the free end 520 engages the corresponding loop 504. In other embodiments, the channel 516 may include a second seat positioned within the arms 520B and vertically lower than the seat within arms 520A such that the rod 502A is positioned vertically lower (and engages loop 504) when engaged with the second seat.

In at least some embodiments, a spring or other biasing element (not shown) within the corresponding channel 516 biases the rod 502 vertically downwards. Accordingly, when the rod 502 is rotationally oriented in the first position, the spring biases the rod 502 downward, forcing the tabs 514 into contact with the seat. When the rod 502 is rotated into the rotational orientation corresponding to the second position, the rod 502 is bias downward such that the free end 520 is engaged with the corresponding loop 504.

Figure 32:
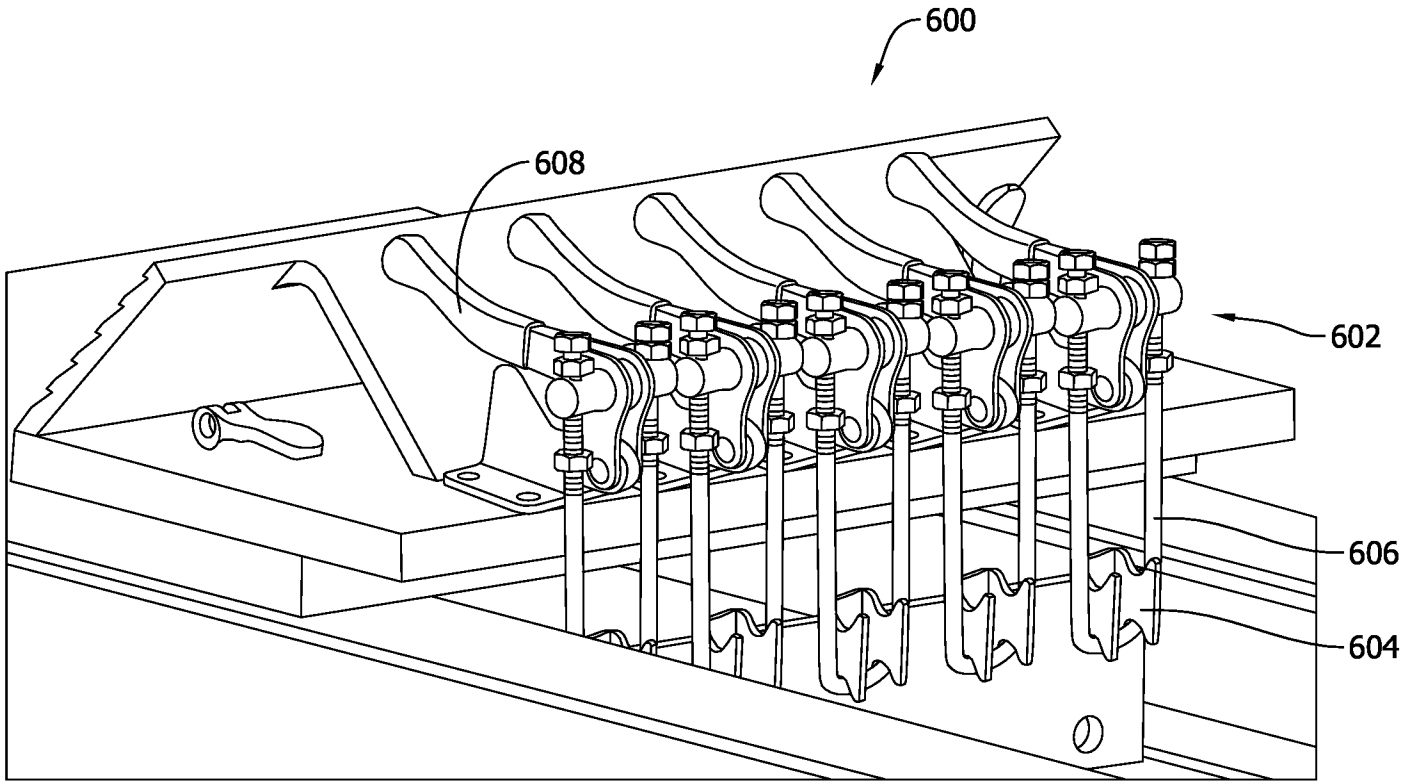
FIG. 32 is a perspective view of another embodiment of a coupling assembly suitable for use with the exercise apparatus of FIGS. 1 and 15.

FIG. 32 depicts another embodiment of a coupling assembly 600 suitable for use with the exercise apparatus 100 or the exercise apparatus 300. In the exemplary embodiment, the coupling assembly 600 includes a plurality of latches 602. Each latch 602 may be selectively actuated from a first position to a second position to engage a link 604. Each link 604 is coupled to the first end of a corresponding resistance band (not shown in FIG. 32). In the illustrated embodiment, all latches 602 are shown in the second (engaged) position. Each latch 602 may be subsequently actuated from the second position to the first position to disengage the corresponding link 604.

Each latch 602 includes a u-bolt 606 in the illustrated embodiment, configured to loop around and engage the corresponding link 604, as well as a handle 608 to selectively actuate the latch 602 between the first and second positions. To selectively transition any latch 602 to the first position, the user lifts the handle 608, which releases tension on the u-bolt 606 and enables the user to disengage the u-bolt 606 from the corresponding link 604. In other embodiments, the latch 602 may include a rod or pin (e.g., similar to the rods or push-pins described herein) that is received a loop connected to the end of a resistance band. In such embodiments, the rod or pin may be raised or lowered by actuation of the latch to engage and disengage a corresponding resistance band.

Although specific features of various embodiments of the disclosure may be shown in some drawings and not in others, this is for convenience only. In accordance with the principles of the disclosure, any feature of a drawing may be referenced and/or claimed in combination with any feature of any other drawing.

This written description uses examples to illustrate the present disclosure, including the best mode, and also to enable any person skilled in the art to practice the disclosure, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. An exercise apparatus comprising:

a stationary foot platform;

a slidable foot platform including a foot block having an inclined surface for engagement with a user's active foot, the slidable foot platform moveable between a first position in which the slidable foot platform is adjacent to the stationary foot platform and a second, extended position in which the slidable foot platform is spaced from the stationary foot platform;

a plurality of resistance members selectively couplable to the slidable foot platform to selectively adjust a resistance on the slidable foot platform; and a coupling assembly including a plurality of vertical rods coupled vertically to the slidable foot platform, wherein each rod of the plurality of vertical rods is selectively translatable along a vertical axis to couple the respective rod to a corresponding resistance member of the plurality of resistance members to couple the corresponding resistance member to the slidable foot platform, wherein the resistance on the slidable foot platform imparted by one or more of the plurality of resistance members coupled to the slidable foot platform by a corresponding one or more of the plurality of vertical rods increases as the slidable foot platform is moved from the first position to the second, extended position.

2. The exercise apparatus of claim 1, wherein, when the slidable foot platform is in the first position, each of the plurality of vertical rods is aligned with a first end of a corresponding one of the plurality of resistance members.

3. The exercise apparatus of claim 1, wherein each rod is configured to be translated downwardly along the vertical axis into engagement with a corresponding one of the plurality of resistance members to selectively couple the corresponding resistance member to the slidable foot platform.

4. The exercise apparatus of claim 1, further comprising a pair of linear tracks extending parallel to one another, wherein the slidable foot platform is coupled to and slidable along the pair of linear tracks.

5. The exercise apparatus of claim 4, further comprising a hinge assembly, the hinge assembly comprising a hinge coupled to the pair of linear tracks, wherein each linear track comprises a respective first portion hingedly coupled to a respective second portion by the hinge.

6. The exercise apparatus of claim 1, further comprising a base, wherein first ends of the plurality of resistance members are selectively couplable to the slidable foot platform and second ends of the plurality of resistance members are fixedly coupled to the base.

* * * * *